US010756450B2

(12) United States Patent
Matsunaga et al.

(10) Patent No.: US 10,756,450 B2
(45) Date of Patent: Aug. 25, 2020

(54) TERMINAL AND ELECTRIC WIRE WITH THE SAME

(71) Applicant: YAZAKI CORPORATION, Tokyo (JP)

(72) Inventors: Takashi Matsunaga, Makinohara (JP); Koichi Ikebe, Makinohara (JP); Keiichiro Kurashige, Makinohara (JP); Youji Kutsuna, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/656,557

(22) Filed: Oct. 17, 2019

(65) Prior Publication Data

US 2020/0127390 A1 Apr. 23, 2020

(30) Foreign Application Priority Data

Oct. 19, 2018 (JP) ..... 2018-197480

(51) Int. Cl.

| | |
|---|---|
| ***H01R 4/10*** | (2006.01) |
| ***H01R 4/18*** | (2006.01) |
| ***H01R 4/242*** | (2018.01) |
| *H01R 13/506* | (2006.01) |
| *H01R 13/424* | (2006.01) |

(52) U.S. Cl.

CPC ..... *H01R 4/185* (2013.01); *H01R 4/242* (2013.01); *H01R 13/424* (2013.01); *H01R 13/506* (2013.01)

(58) Field of Classification Search

CPC .. H01R 13/4362; H01R 4/185; H01R 13/424; H01R 13/506; H01R 4/242; H04R 19/016

See application file for complete search history.

(56) References Cited

U.S. PATENT DOCUMENTS

| | | | | |
|---|---|---|---|---|
| 5,595,509 | A * | 1/1997 | Fry | H01R 13/4362 439/595 |
| 2003/0013353 | A1 | 1/2003 | Sakaguchi et al. | |
| 2011/0280418 | A1* | 11/2011 | Matsunaga | H04R 19/016 381/174 |
| 2015/0340793 | A1* | 11/2015 | Kutsuna | H01R 13/4362 439/733.1 |
| 2018/0261946 | A1* | 9/2018 | Hori | H01R 13/424 |

FOREIGN PATENT DOCUMENTS

| | | |
|---|---|---|
| JP | 2003-31274 A | 1/2003 |

* cited by examiner

*Primary Examiner* — Jean F Duverne

(74) *Attorney, Agent, or Firm* — Kenealy Vaidya LLP

(57) ABSTRACT

A terminal is to be connected to an electric wire including a conductor core wire and a sheath covering the conductor core wire. The terminal includes a connection portion and a conductor fixing portion which is located rearward of the connecting portion and configured to fix the conductor core wire exposed from the electric wire. The connection portion and the conductor fixing portion are integrally formed to each other and are extended in a front-rear direction. The conductor fixing portion has through holes penetrating in a thickness direction of the conductor fixing portion. An end edge portion of each of the plurality of through holes on an outer peripheral surface side of the conductor fixing portion is provided with a tapered portion that increases in diameter of the tapered portion toward an outer peripheral surface of the conductor fixing portion.

4 Claims, 37 Drawing Sheets

TERMINAL AND ELECTRIC WIRE WITH THE SAME

CROSS REFERENCE TO RELATED APPLICATIONS

This application is based on Japanese Patent Application (No. 2018-197480) filed on Oct. 19, 2018, the contents of which are incorporated herein by reference.

BACKGROUND OF THE INVENTION

1. Field of the Invention

The present invention relates to a terminal and an electric wire with terminal.

2. Description of the Related Art

In related art, there has been a terminal that is configured to be connected to a tip end of an electric wire including a conductor core wire and a sheath that covers the conductor core wire, that is manufactured with a plate-shaped member, and that is provided integrally with a connecting portion configured to be connected to a mating terminal and a conductor fixing portion that is located rearward of the connecting portion and fixes the conductor core wire exposed from the electric wire via pressure contact (see, for example, JP-A-2003-31274).

In the terminal described in the above document, in order to firmly fix the conductor core wire with the conductor fixing portion, a plurality of serrations recessed toward an outer peripheral side are formed on an inner peripheral surface of the conductor fixing portion (a surface in contact with the conductor core wire).

In recent years, in response to a demand for miniaturization of connectors, terminals have been miniaturized and thinned. If a thickness of a metal plate constituting the conductor fixing portion of the terminal is small, even when the conductor core wire is fixed by a tightening force of the conductor fixing portion via pressure contact, the conductor core wire is likely to be separated from the conductor fixing portion due to a small tightening force, a tightening force that is likely to reduce due to aging, or the like.

SUMMARY OF THE INVENTION

The present invention has been made in view of the above circumstances, and an object thereof is to provide a terminal and an electric wire with terminal which are capable of maintaining a state in which a conductor core wire is held by a conductor fixing portion of the terminal even when a thickness of a metal plate constituting the conductor fixing portion is small.

In order to achieve the above object, a terminal and an electric wire with the terminal according to the present invention are characterized by the following (1) to (4).

(1) There is provided a terminal that is configured to be connected to a tip end of an electric wire including a conductor core wire and a sheath covering the conductor core wire, the terminal including:

a connection portion configured to be connected to a mating terminal; and a conductor fixing portion located rearward of the connecting portion and configured to fix the conductor core wire exposed from the electric wire, wherein the connection portion and the conductor fixing portion are integrally formed to each other and are extended in a front-rear direction;

wherein the conductor fixing portion has a plurality of through holes penetrating in a thickness direction which is substantially perpendicular to both of the front-rear direction and a width direction of the conductor fixing portion; and wherein an end edge portion of each of the plurality of through holes on an outer peripheral surface side of the conductor fixing portion is provided with a tapered portion that increases in diameter of the tapered portion toward an outer peripheral surface of the conductor fixing portion.

(2) For example, one of the plurality of through holes is located at a center in the front-rear direction and at a center in the width direction of the conductor fixing portion.

(3) For example, the electric wire is mounted on an inner peripheral surface of the conductor fixing portion which is opposite to the outer peripheral surface.

(4) There is also provided an electric wire with a terminal, including:

the terminal according to any one of the above (1) to (3); and the electric wire whose conductor core wire is fixed by the conductor fixing portion via pressure contact, in which the conductor core wire enters into the tapered portions of the through holes and is in close contact with the tapered portions.

According to the terminal of the above (1), for example, when the conductor core wire is fixed via pressure contact, the conductor core wire can enter into the tapered portions of the through holes and be in close contact with the tapered portions due to a pressure during pressure contact. Therefore, even if the conductor core wire tends to be separated from the conductor fixing portion due to a small tightening force of the conductor fixing portion caused by a small thickness of the metal plate constituting the conductor fixing portion, portions of the conductor core wire that are in close contact with the tapered portions (hereinafter referred to as "tapered contact portions") are hooked by the tapered portions. As a result, the conductor core wire can be held on the conductor fixing portion. That is, it is possible to maintain a state in which the conductor core wire is held by the conductor fixing portion of the terminal even when the thickness of the metal plate constituting the conductor fixing portion is small.

Further, even if the conductor core wire tends to be separated from the conductor fixing portion due to expansion and contraction of the conductor fixing portion caused by temperature variation, since the tapered contact portions of the conductor core wire are respectively hooked by the tapered portions, the conductor core wire follows the expansion and contraction of the conductor fixing portion. As a result, a contact area between the conductor core wire and the conductor fixing portion is unlikely to reduce, and a contact resistance can be prevented from rising. Further, appearance inspection for checking entering amounts of the conductor core wire into the through holes can be performed visually, which contributes to prevention of outflow of terminals having pressure contact failure.

According to the terminal of the above (2), by performing pressure contact on an anvil in a positioning state in which projections provided on the anvil are inserted into the through hole penetrating in the upper-lower direction at the center in the front-rear direction and the width direction of the conductor fixing portion, the terminal (the conductor fixing portion) can be elongated uniformly in the front-rear direction and the width direction via pressure contact. As a result, quality related to pressure contact can be managed easily.

According to the electric wire with the terminal of the above (4), for example, when the conductor core wire is fixed via pressure contact, the conductor core wire can enter the tapered portions of the through holes and be in close contact with the tapered portions due to a pressure during pressure contact. Therefore, even if the conductor core wire tends to be separated from the conductor fixing portion due to a small tightening force of the conductor fixing portion caused by a small thickness of the metal plate constituting the conductor fixing portion, the tapered contact portion is hooked by the tapered portion. As a result, the conductor core wire can be held on the conductor fixing portion. That is, it is possible to maintain a state in which the conductor core wire is held by the conductor fixing portion of the terminal even when the thickness of the metal plate constituting the conductor fixing portion is small.

Further, even if the conductor core wire tends to be separated from the conductor fixing portion due to expansion and contraction of the conductor fixing portion caused by temperature variation, since the tapered contact portions of the conductor core wire are respectively hooked by the tapered portions, the conductor core wire follows the expansion and contraction of the conductor fixing portion. As a result, a contact area between the conductor core wire and the conductor fixing portion is unlikely to reduce, and a contact resistance can be prevented from rising. Further, appearance inspection for checking entering the amounts of the conductor core wire into the through holes can be performed visually, which contributes to prevention of outflow of terminals having pressure contact failure.

According to the present invention, it is possible to provide a terminal and an electric wire with terminal which are capable of maintaining a state in which a conductor core wire is held by a conductor fixing portion of the terminal even when a thickness of a metal plate constituting the conductor fixing portion is small.

The present invention has been briefly described above. Details of the present invention is further clarified by reading a mode for carrying out the invention (hereinafter, referred to as "embodiment") described below with reference to attached drawings.

DESCRIPTION OF EMBODIMENTS

Embodiment

Hereinafter, a connector 1 according to an embodiment of the present invention will be described with reference to the drawings. Hereinafter, for convenience of description, in an axial direction (fitting direction) of the connector 1, a side on which a mating terminal (not shown) is fitted (left side in FIG. 1) is referred to as a front side, and an opposite side thereof (right side in FIG. 1) is referred to as a rear side. An upper side and a lower side in FIG. 1 are referred to as an upper side and a lower side, respectively.

Figure 1:
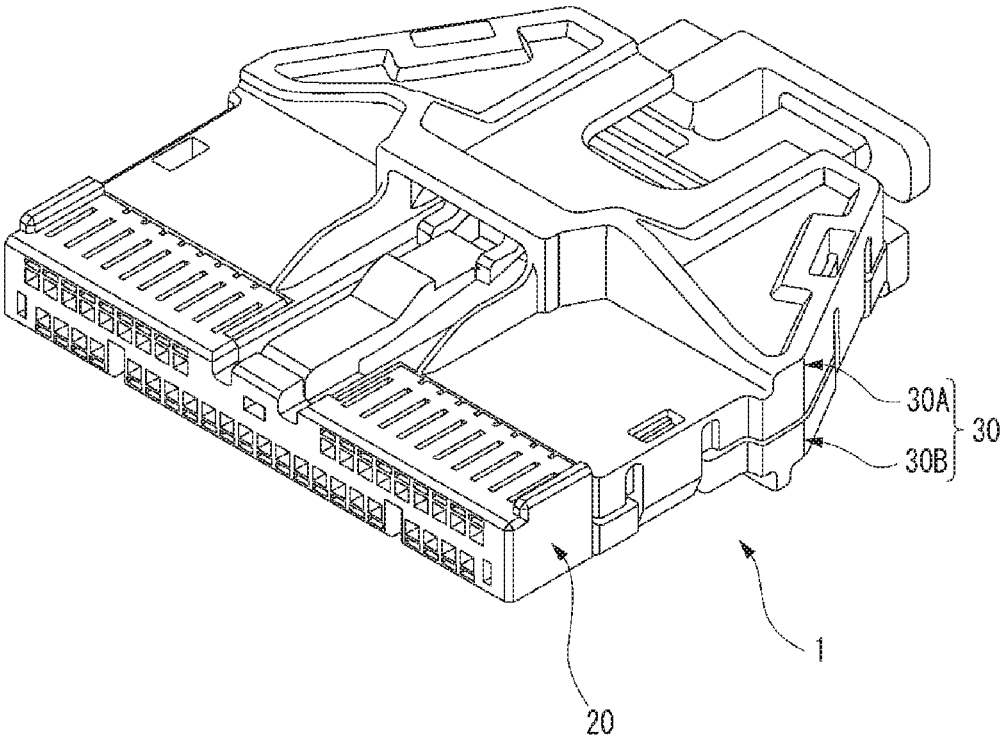
FIG. 1 is a perspective view of a connector according to the present embodiment.
Figure 2:
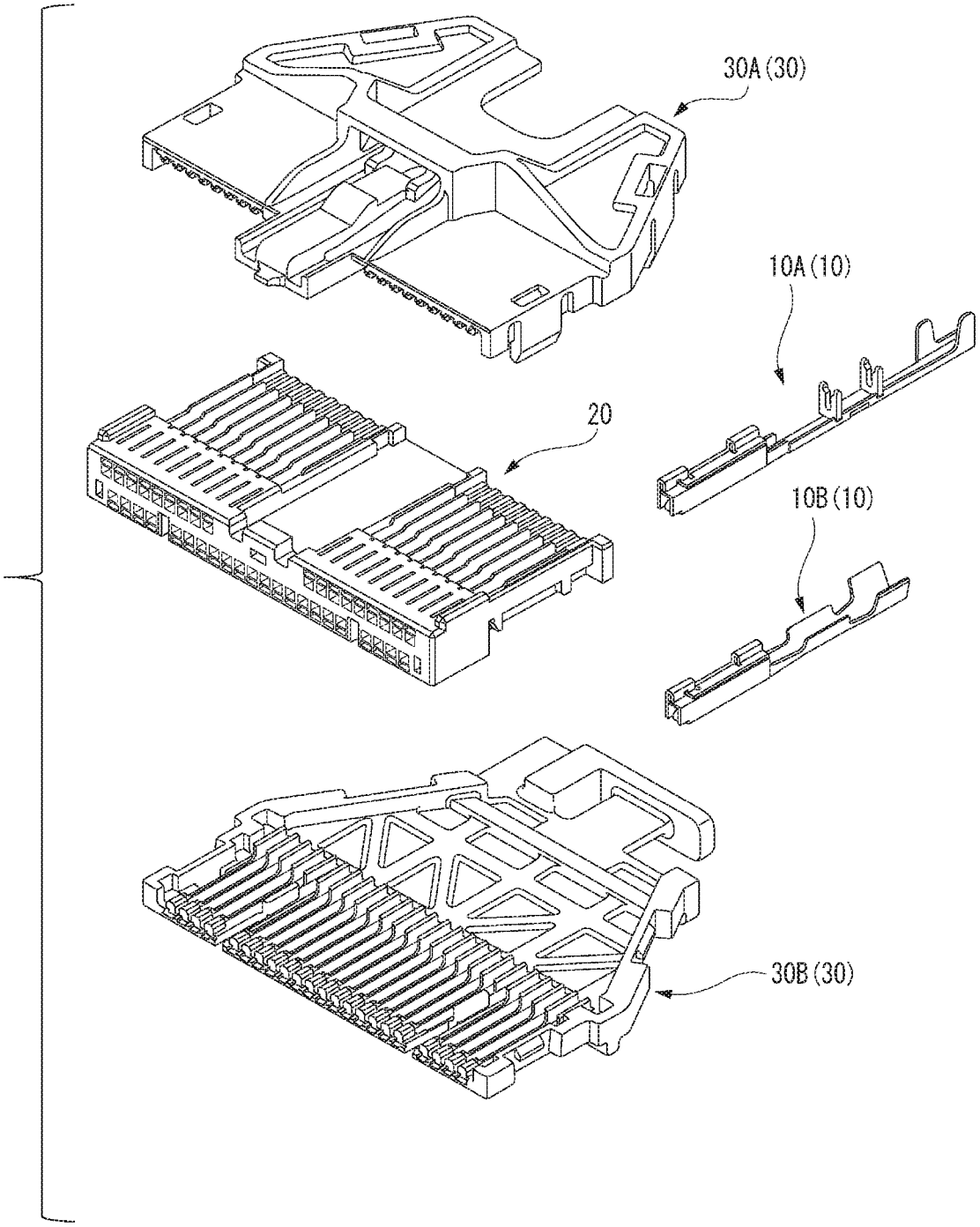
FIG. 2 is an exploded perspective view of the connector shown in FIG. 1.

As shown in FIGS. 1 and 2, the connector 1 includes terminals 10, a housing 20, and a cover 30. Hereinafter, each component constituting the connector 1 will be described in order.

First, the terminals 10 will be described with reference to FIGS. 3 to 5. In this example, a terminal 10A shown in FIG. 3 and a terminal 10B shown in FIG. 4 are used as the terminals 10. Both the terminals 10A, 10B are female terminals formed by performing pressing, bending, or the like on a plate-shaped metal member, and include a connecting portion 11 to which a mating terminal (male terminal, not shown) is fitted, a conductor fixing portion 12 for fixing a conductor core wire of an electric wire (not shown) to a rear side of the connecting portion 11, and a sheath fixing portion 13 which is continuous with the rear side of the conductor fixing portion 12 and fixes a covering of the electric wire.

The connecting portion 11 of the terminals 10A, 10B has a rectangular tubular shape, and a pair of projecting portions 14 projecting upward are formed on both end portions in the front-rear direction on one side in the width direction of an upper surface of the connecting portion 11. In particular, the projecting portion 14 on the front side of the pair of projecting portions 14 engages with a lance 26 (see FIG. 8) of the housing 20, and performs a coming off preventing function of the terminals 10A, 10B, as will be described later.

Figure 3:
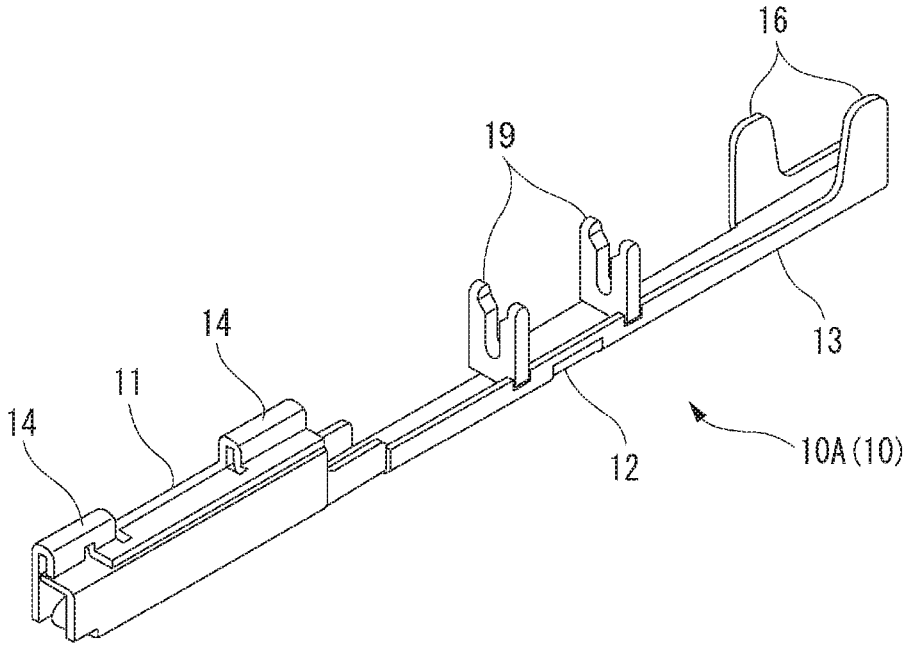
FIG. 3 is a perspective view of a first terminal shown in FIG. 2.
Figure 4:
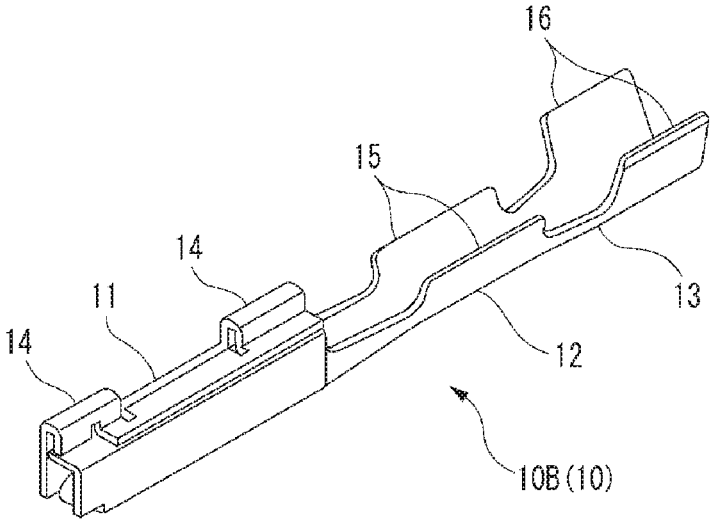
FIG. 4 is a perspective view of a second terminal shown in FIG. 2.

As shown in FIG. 3, a pair of pressure welding blades 19 are formed on the conductor fixing portion 12 of the terminal 10A. The conductor core wire of the electric wire is pressure-welded to the pressure welding blades 19, whereby the conductor core wire is fixed to and electrically connected with the conductor fixing portion 12. On the other hand, as shown in FIG. 4, a pair of crimping pieces 15 are formed on the conductor fixing portion 12 of the terminal 10B. The conductor core wire of the electric wire is pressure-bonded to the crimping pieces 15, whereby the conductor core wire is fixed to and electrically connected with the conductor fixing portion 12. A pair of crimping pieces 16 are formed on the sheath fixing portion 13 of the terminals 10A, 10B. The electric wire is fixed to the sheath fixing portion 13 by pressure-contact the sheath of the electric wire with the crimping pieces 16.

Figure 5:
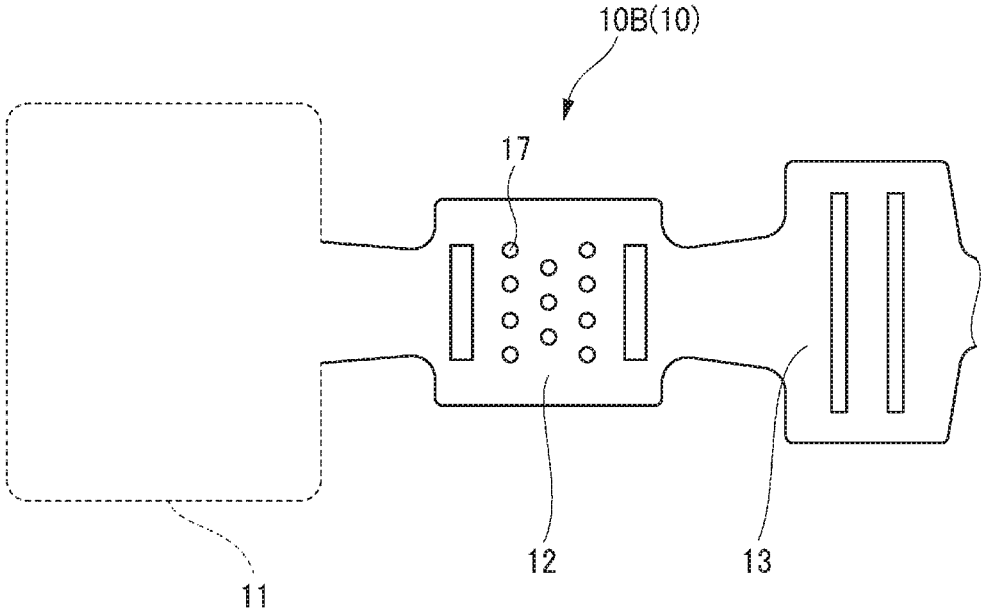
FIG. 5 is a plate-shaped metal member used to manufacture the second terminal.

The terminal 10B is formed by performing pressing, bending or the like on a plate-shaped metal member shown in FIG. 5. In FIG. 5, the connection portion 11 is shown schematically (see a broken line portion). As can be understood from FIG. 5, a plurality of through holes 17 penetrating in a thickness direction are formed in the conductor fixing portion 12 of the terminal 10B. By providing the through holes 17 as described above, when the conductor core wire is pressure-bonded to the conductor fixing portion 12, the conductor core wire can enter the through holes 17 and be in close contact with to an inner wall surface of the through hole 17 due to a pressure during pressure contact. As a result, the conductor core wire can be firmly fixed to the conductor fixing portion 12. Further, since a contact area between the conductor core wire and the conductor fixing portion 12 increases, a contact resistance therebetween decreases. A detailed shape of the through holes 17 of the conductor fixing portion 12 of the terminal 10B will be described in detail later.

Figure 6:
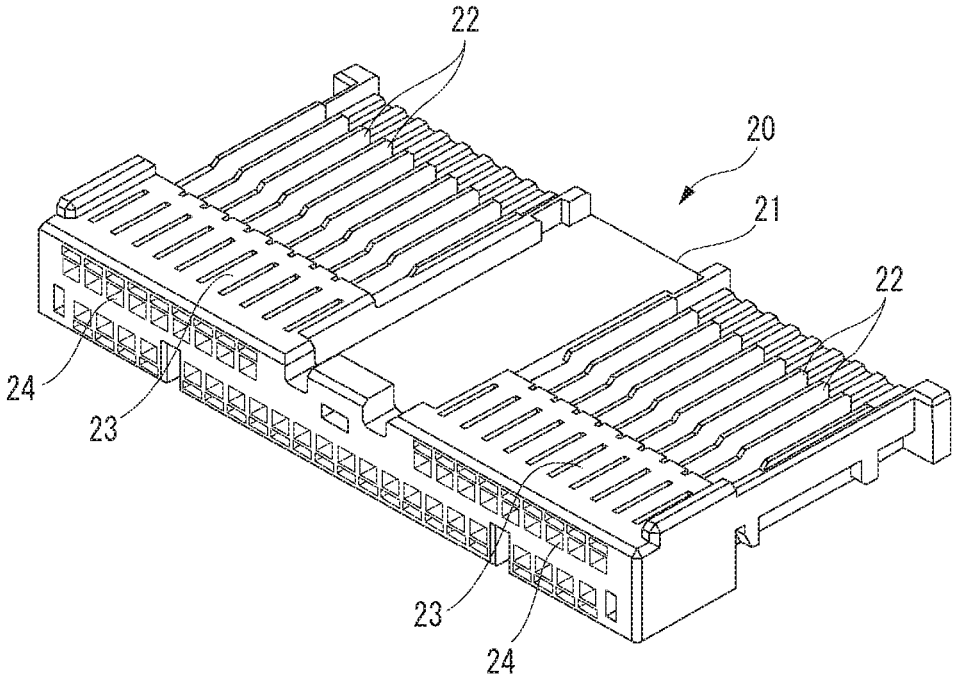
FIG. 6 is a perspective view of a housing shown in FIG. 2.
Figure 7:
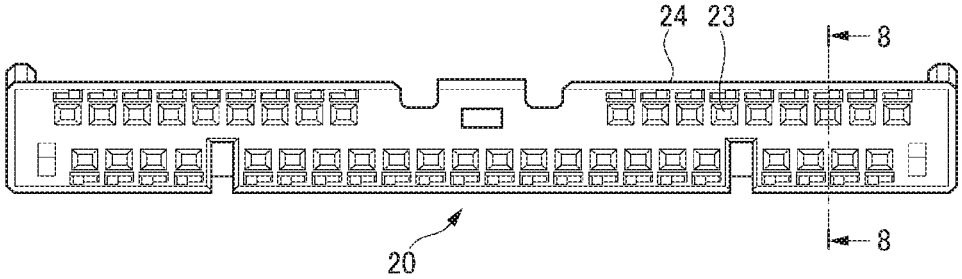
FIG. 7 is a front view of the housing.

Next, the housing 20 will be described with reference to FIGS. 6 to 12. In particular, as shown in FIGS. 6 and 9, the housing 20 includes a housing main body 21 having a rectangular flat plate shape. A plurality of terminal accommodating portions for accommodating a plurality of the terminals 10 are formed on each of upper and lower surfaces of the housing main body 21. Configurations of the upper surface side and the lower surface side of the housing main body 21 are slightly different from each other, but are substantially the same, and only the configuration of the upper surface side of the housing main body 21 will be described below.

A plurality of standing walls 22 extending in the front-rear direction at intervals in the width direction are integrally formed on the upper surface of the housing main body 21. Each standing wall 22 performs a function of partitioning two terminal accommodating portions adjacent in the width direction. That is, the plurality of terminal accommodating portions partitioned by the plurality of standing walls 22 are formed on the upper surface of the housing main body 21 so as to be aligned in the width direction.

Top wall portions 23 are formed integrally on a front side portion of the housing main body 21 so as to close upper sides of the terminal accommodating portions. That is, a front side portion of each terminal accommodating portion has a cylindrical shape whose upper side is closed by one of the top wall portions 23, and an upper portion of a rear portion of the terminal accommodating portion is opened. An opening 24 is formed at the front side end of each terminal accommodating portion (see FIGS. 6 to 8). The mating terminal (male terminal) is inserted into the terminal accommodating portion of the housing main body 21 through the opening 24.

Figure 8:
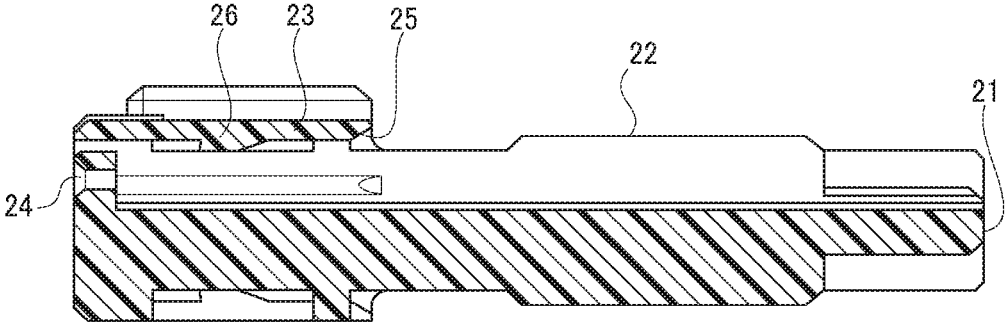
FIG. 8 is a cross-sectional view taken along line 8-8 of FIG. 7.
Figure 9:
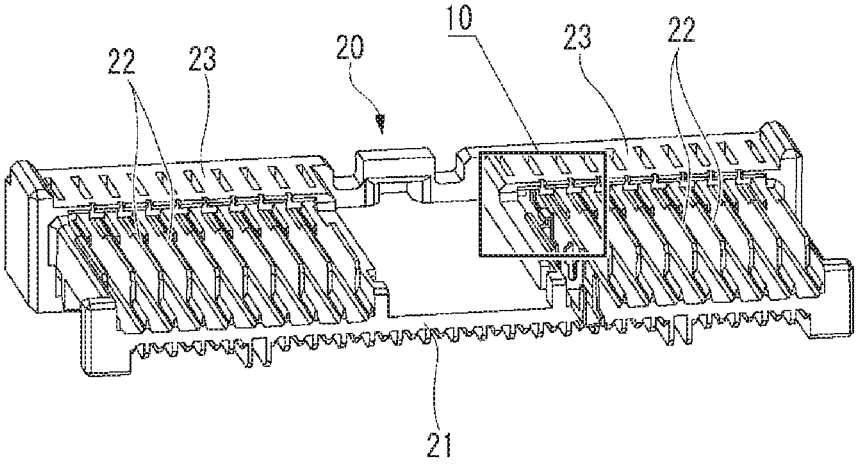
FIG. 9 is a perspective view of the housing as viewed from a rear side.

As shown in FIG. 8, a tapered surface 25 inclined rearward and downward is formed at a rear end edge of each top wall portion 23. As will be described later, the tapered surface 25 is used when an upper cover 30A is assembled to the housing 20 (see FIG. 21). A lance 26 projecting downward into each terminal accommodating portion is integrally formed on a lower surface of a central portion in the front-rear direction of the top wall portion 23.

Figure 10:
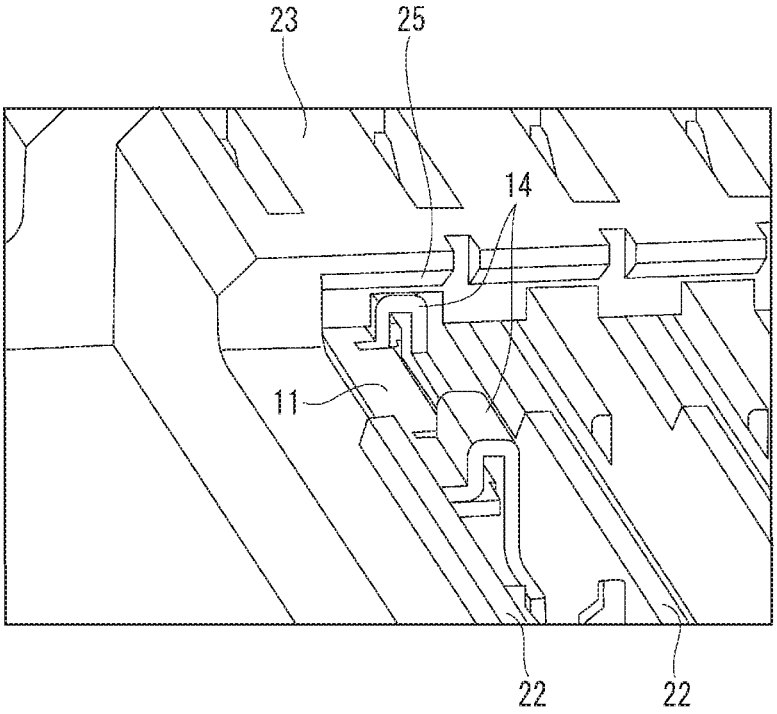
FIG. 10 is an enlarged view of a frame shown by reference numeral 10 in FIG. 9.

As described above, in the housing main body 21, the upper side of the rear portion of each terminal accommodating portion is opened. Therefore, by placing the terminal 10 on the rear portion of the terminal accommodating portion as shown in FIGS. 9 and 10 while holding the terminal 10, the terminal 10 can be easily inserted into the primary locking position (intermediate insertion position) in the vicinity of a regular insertion position on the front side portion (the tubular portion) of the terminal accommodating portion (see FIGS. 11 and 12).

Figure 11:
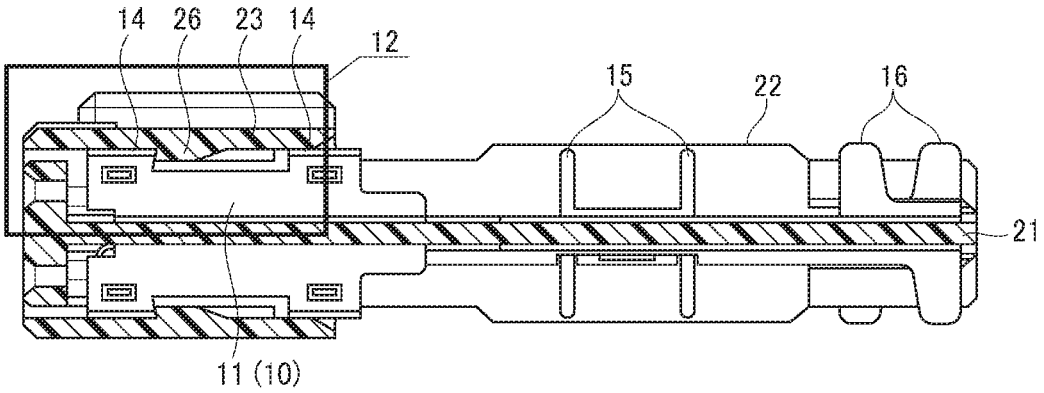
FIG. 11 is a cross-sectional view corresponding to FIG. 8 in the housing in which the terminal is in a primary locking position.
Figure 12:
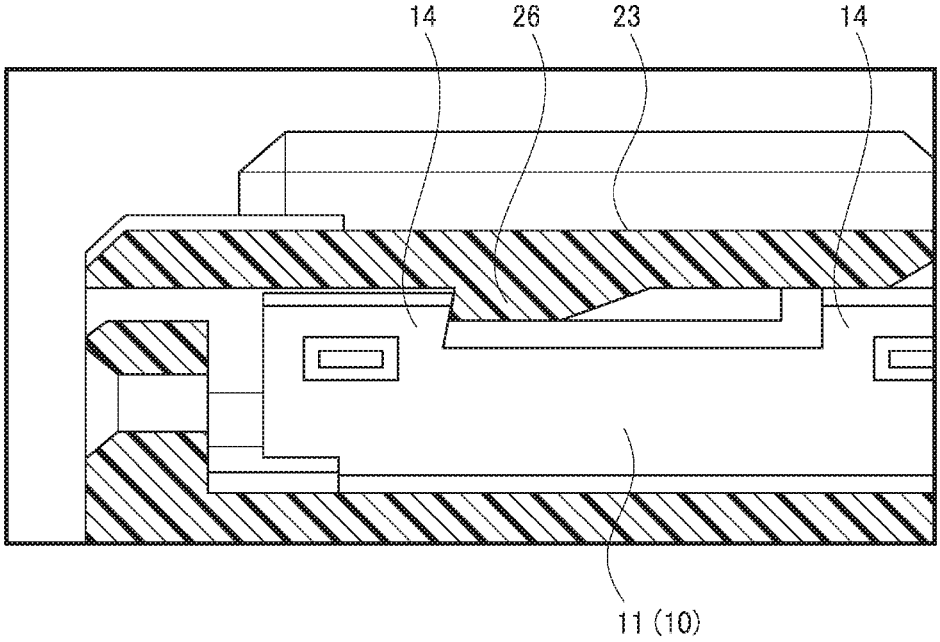
FIG. 12 is an enlarged view of a frame shown by reference numeral 12 in FIG. 11.

In the process in which the terminal 10 is inserted into the primary locking position shown in FIGS. 11 and 12, the lance 26 is brought into contact with the projecting portion 14 on the front side of the terminal 10 to ride on the projecting portion 14 while elastically deforming, and then elastically returns to an initial position when the projecting portion 14 has passed by. As a result, as shown in FIG. 12, the projecting portion 14 engages with the lance 26, so as to perform a retaining function of the terminal 10 from the housing 20.

Next, the cover 30 will be described with reference to FIGS. 13 to 22. In this example, an upper cover 30A and a lower cover 30B are used as the cover 30 (see FIG. 2). The upper cover 30A is assembled to the upper surface side of the housing main body 21 to cover the upper side of the rear portion of the terminal accommodating portions on the upper surface side, and the lower cover 30B is assembled to the lower surface side of the housing main body 21 to cover the lower side of the rear portion of the terminal accommodating portions on the lower surface side.

Figure 13:
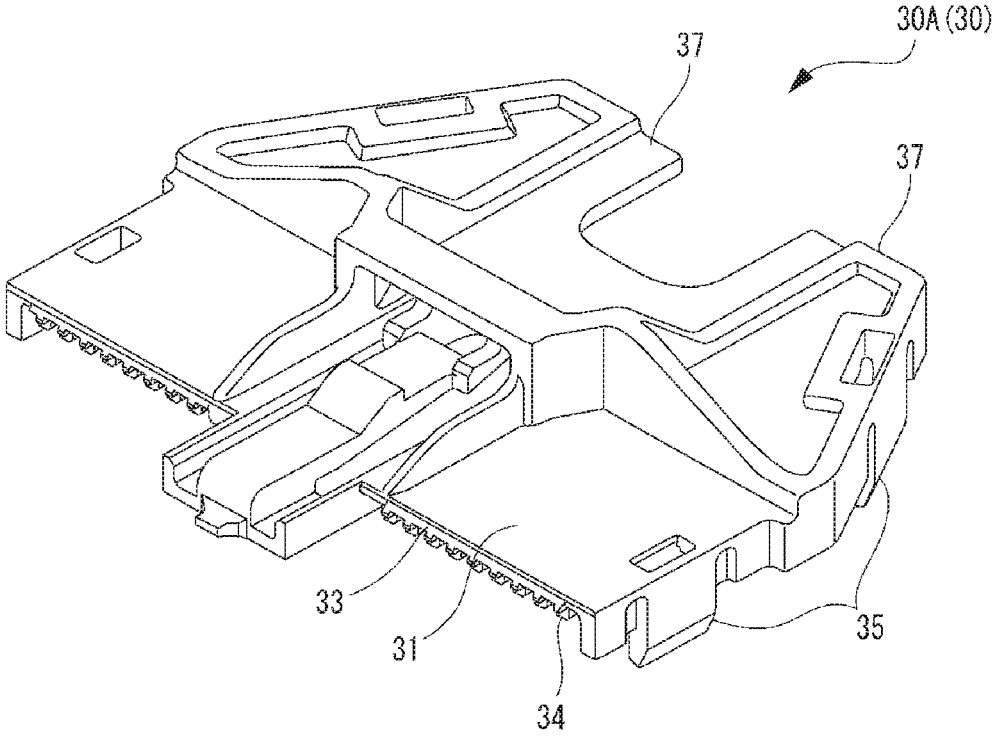
FIG. 13 is a perspective view of an upper cover shown in FIG. 2.
Figure 14:
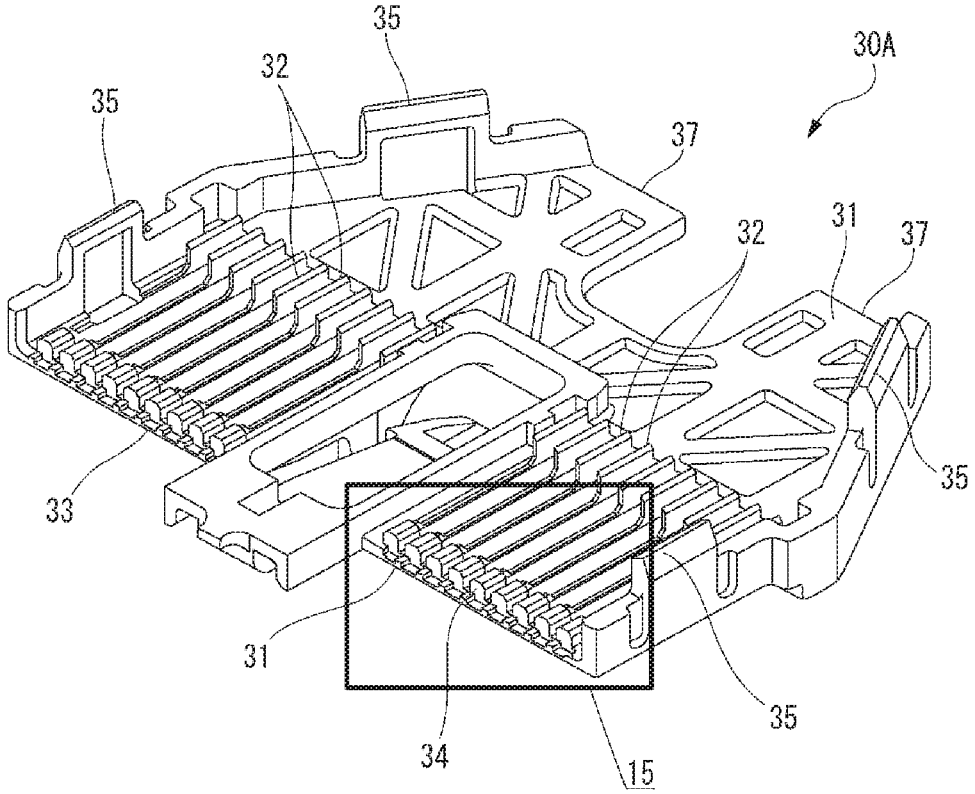
FIG. 14 is a perspective view of the reversed upper cover.

First, the upper cover 30A will be described with reference to FIGS. 13 to 15. FIG. 13 shows the upper cover 30A in an orientation of assembly to the housing main body 21, and FIG. 14 shows the reversed upper cover 30A.

The upper cover 30A includes a flat plate-shaped cover main body 31. A plurality of standing walls 32 extending in the front-rear direction are integrally formed at intervals in the width direction on the lower surface of the front side portion of the cover main body 31 so as to correspond to the standing walls 22 of the housing main body 21. Thus, in a state in which the upper cover 30A is assembled to the housing 20, the upper cover 30A covers the upper side of the rear portions of the terminal accommodating portions of the housing main body 21, so as to form terminal accommodating portions having a tubular shape continuing in the front-rear direction in the front side portions and the rear portions of the terminal accommodating portions.

Each front end edge of the cover main body 31 of the upper cover 30A is formed with a tapered surface 33 inclined forward and upward. As will be described later, the tapered surface 33 is used when the upper cover 30A is assembled to the housing 20 (see FIG. 21).

Figure 15:
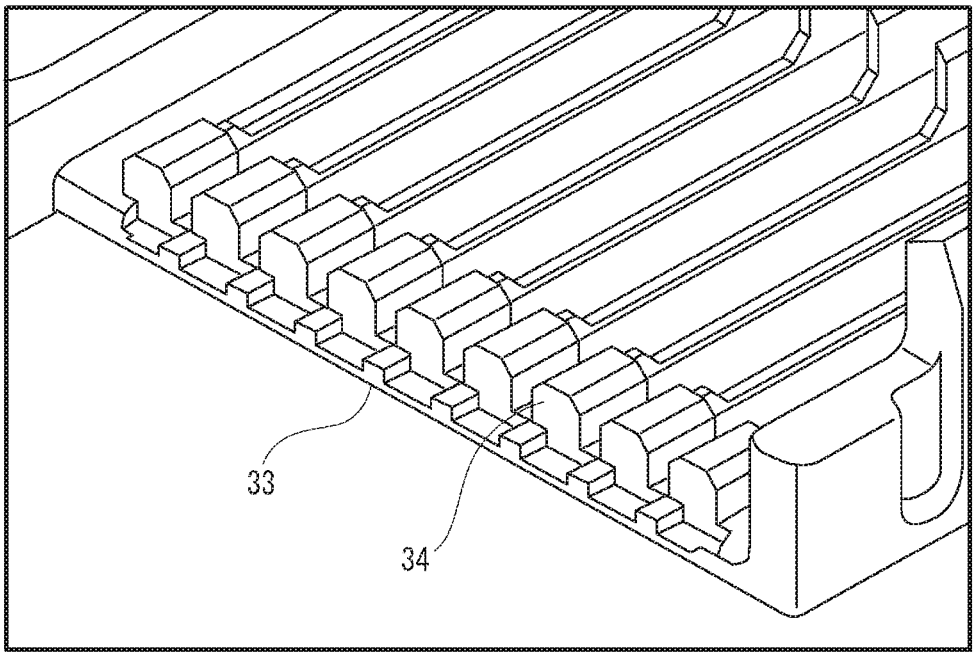
FIG. 15 is an enlarged view of a frame shown by reference numeral 15 in FIG. 14.

As shown in FIG. 15, on the lower surface of the front end portion of the cover main body 31 of the upper cover 30A, a plurality of projecting portions 34 protruding downward are integrally formed at positions of the plurality of terminal accommodating portions (positions between adjacent standing walls 32) in the width direction. As will be described later, when the upper cover 30A is assembled to the housing 20, each projecting portion 34 has a function of pressing the terminal 10 at the primary locking position forward to move the terminal 10 to the regular insertion position.

In the state where the upper cover 30A is assembled to the housing 20, the rear portion of the cover main body 31 of the upper cover 30A protrudes rearward from a rear end surface of the housing 20. A rear portion 37 of the cover main body 31 cooperates with a rear portion 37 of the cover main body 31 of the lower cover 30B (see FIGS. 16 and 17) so as to function as a so-called connector cover that accommodates and protects a plurality of electric wires extending rearward from the plurality of terminals 10 accommodated in the plurality of terminal accommodating portions.

Figure 20:
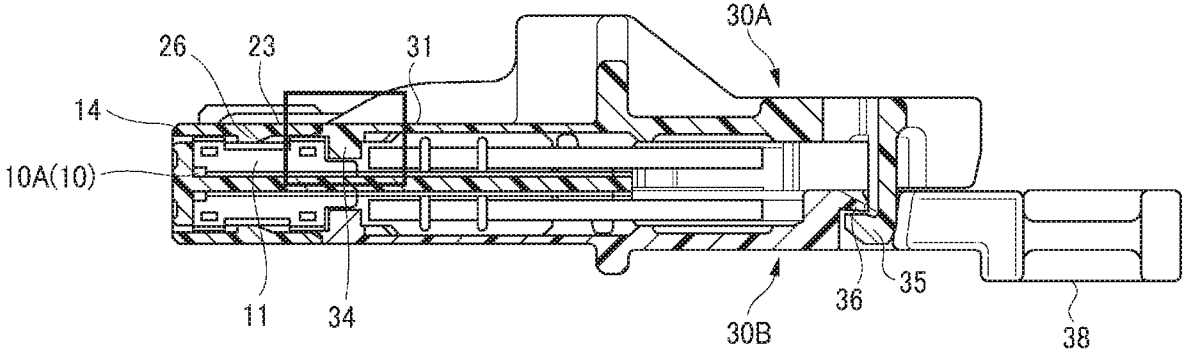
FIG. 20 is a cross-sectional view taken along line 20-20 of FIG. 19.

Engaging portions 35, which respectively engage with engaging portions 36 of the lower cover 30B (see FIGS. 16 and 17) when the upper cover 30A is assembled to the housing 20, are integrally formed at a plurality of positions (four positions in the present embodiment) on both end portions in the width direction of the cover main body 31 of the upper cover 30A (see FIG. 20).

Figure 16:
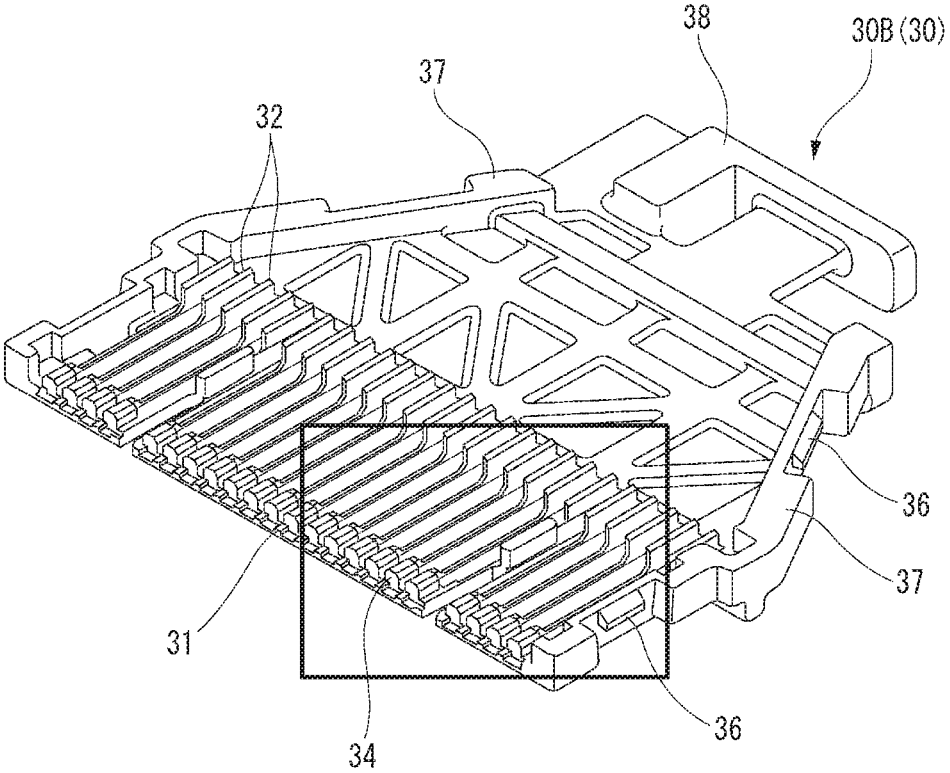
FIG. 16 is a perspective view of a lower cover shown in FIG. 2.
Figure 17:
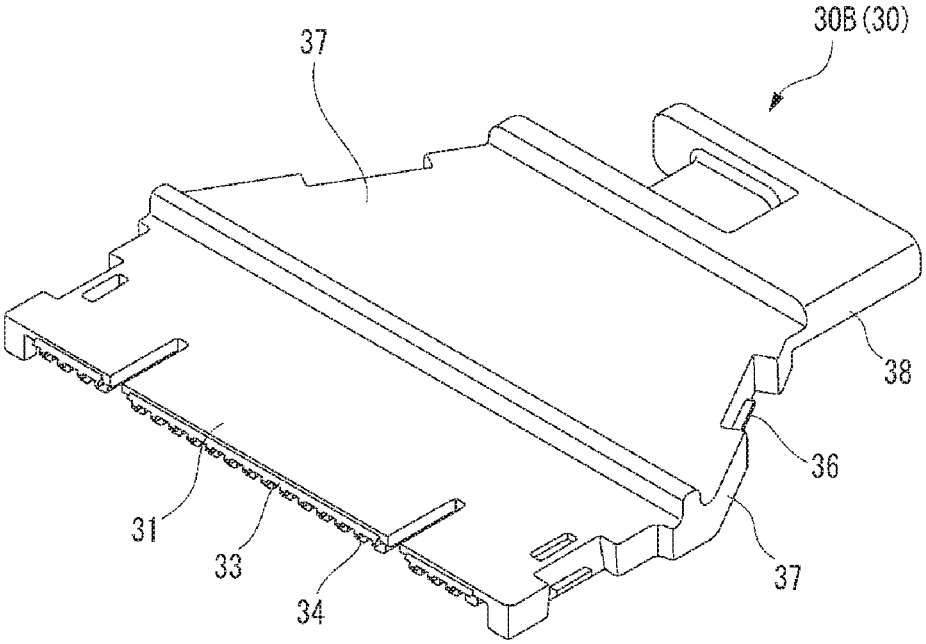
FIG. 17 is a perspective view of the reversed lower cover.
Figure 18:
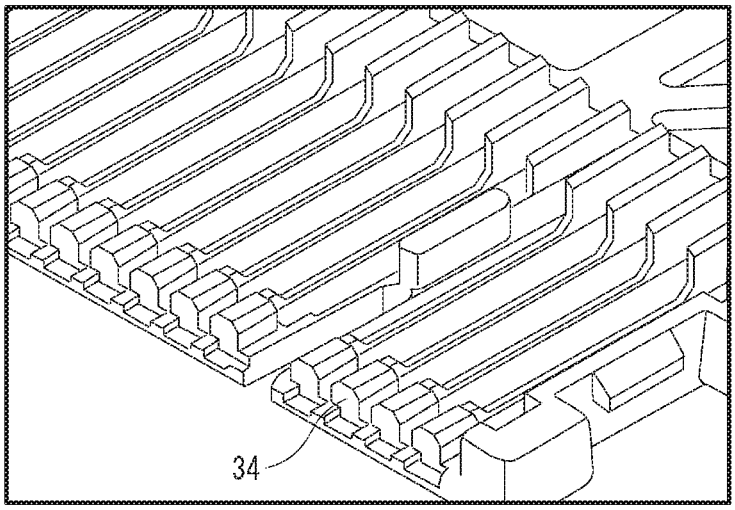
FIG. 18 is an enlarged view of a frame shown by reference numeral 18 in FIG. 16.
Figure 19:
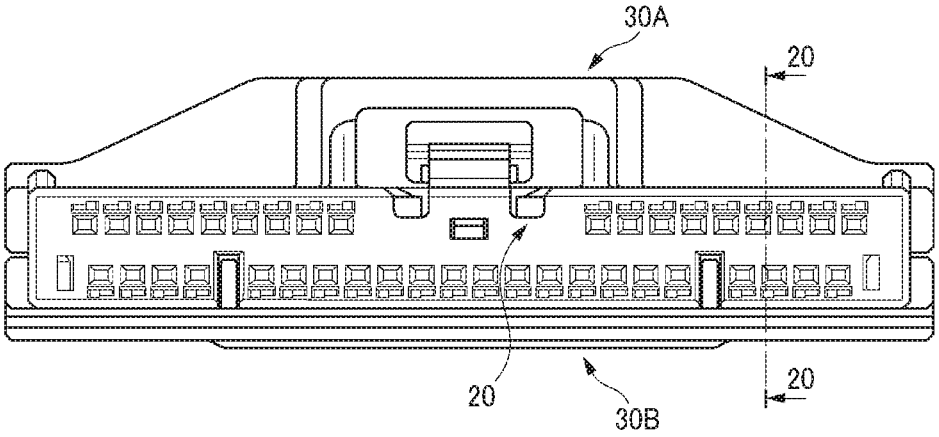
FIG. 19 is a front view of the connector shown in FIG. 1.

Next, the lower cover 30B will be described with reference to FIGS. 16 to 18. FIG. 16 shows the lower cover 30B in the orientation of assembly to the housing main body 21, and FIG. 17 shows the reversed lower cover 30B. The upper cover 30A and the lower cover 30B are slightly different from each other, but are generally the same except that the upper cover 30A and the lower cover 30B are symmetrical in the upper-lower direction. Therefore, the lower cover 30B is denoted with the same reference numerals as the upper cover 30A with respect to the configurations corresponding to each configuration of the upper cover 30A, and the description thereof will be omitted.

In the lower cover 30B, as shown in FIGS. 16 and 17, an electric wire holding portion 38 is integrally formed on the rear side (a rear end portion) of the rear portion 37 functioning as a connector cover. The electric wire holding portion 38 is a portion used to bundle and hold the plurality of electric wires extending rearward from the housing 20. The plurality of electric wires extending rearward from the housing 20 are held by the electric wire holding portion 38 in a bundled state using a tie band or the like.

Figure 21:
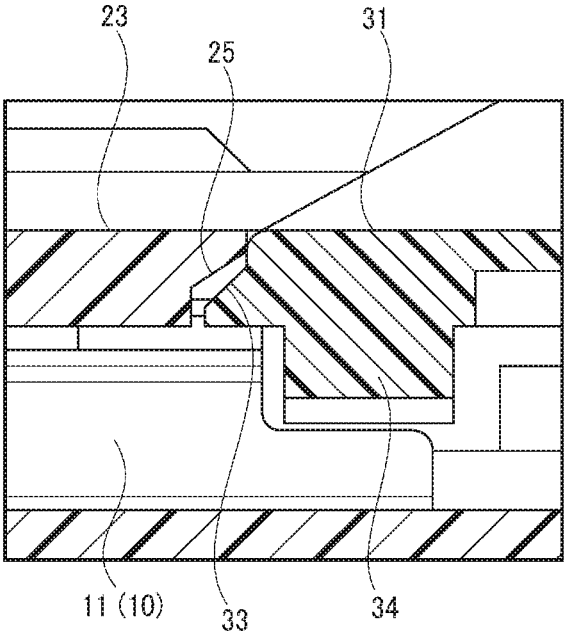
FIG. 21 is an enlarged view of a frame shown by reference numeral 21 in FIG. 20.
Figure 22:
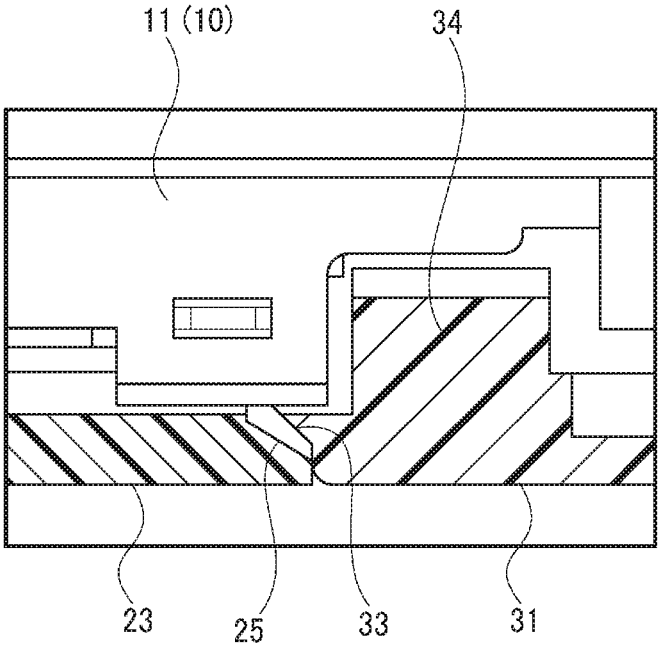
FIG. 22 is a diagram corresponding to FIG. 21 on the lower cover side.

As shown in FIGS. 19 to 22, in a state in which the upper cover 30A and the lower cover 30B are assembled to the housing 20, the front end edges of the upper cover 30A and the rear end edges of the top wall portions 23 on the upper surface side of the housing 20 are locked to one another with the tapered surfaces 33 of the front end edges of the upper cover 30A entering below the tapered surfaces 25 of the rear end edges of the top wall portions 23 on the upper surface side of the housing 20 (see FIG. 21). The front end edges of the lower cover 30B and the rear end edges of the top wall portions 23 on the lower surface side of the housing 20 are locked to one another with the tapered surfaces 33 of the front end edges of the lower cover 30B entering above the tapered surfaces 25 of the rear end edges of the top wall portions 23 on the lower surface side of the housing 20 (see FIG. 22). Further, the plurality of engaging portions 35 of the upper cover 30A and the plurality of engaging portions 36 of the lower cover 30B are locked to one another (see FIG. 20). Due to such cooperation, both the upper cover 30A and the lower cover 30B are assembled to the housing 20 in a relatively unmovable manner, and the upper cover 30A and the lower cover 30B are assembled to each other in a relatively unmovable manner.

Figure 23:
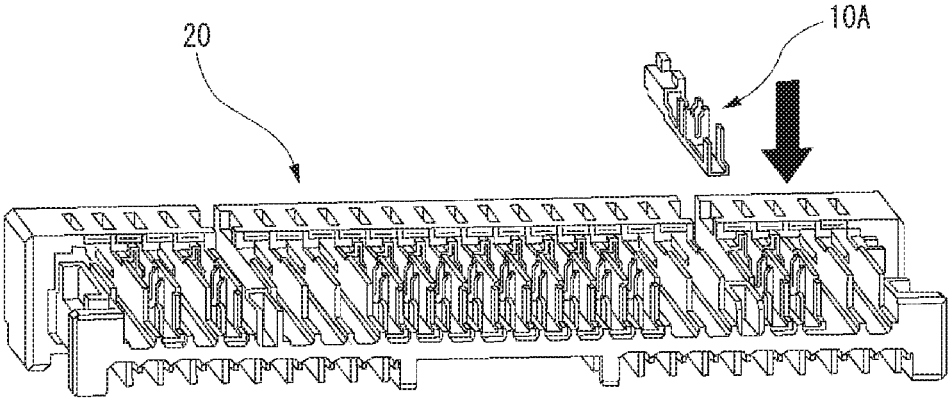
FIG. 23 is a first diagram for explaining a procedure of assembling the connector.

Next, a procedure of assembling the connector 1 will be described with reference to FIGS. 23 to 35, first, as shown in FIG. 23, the terminals 10A are respectively arranged in the rear portions, whose upper portions are opened, of predetermined terminals accommodating portion on the upper surface side (the lower surface side in a regular orientation) of the housing 20 in the reversed state by using a predetermined device, and predetermined portions (typically, rear end surfaces of the rectangular tubular connection portions 11) of the terminals 10A are pushed forward to the primary locking position shown in FIGS. 11 and 12. As a result, the projecting portions 14 of the terminals 10A are respectively locked to the lances 26 of the housing 20, so that the terminals 10A inserted into the terminal accommodating portions can be prevented from coming off from the housing 20.

Figure 24:
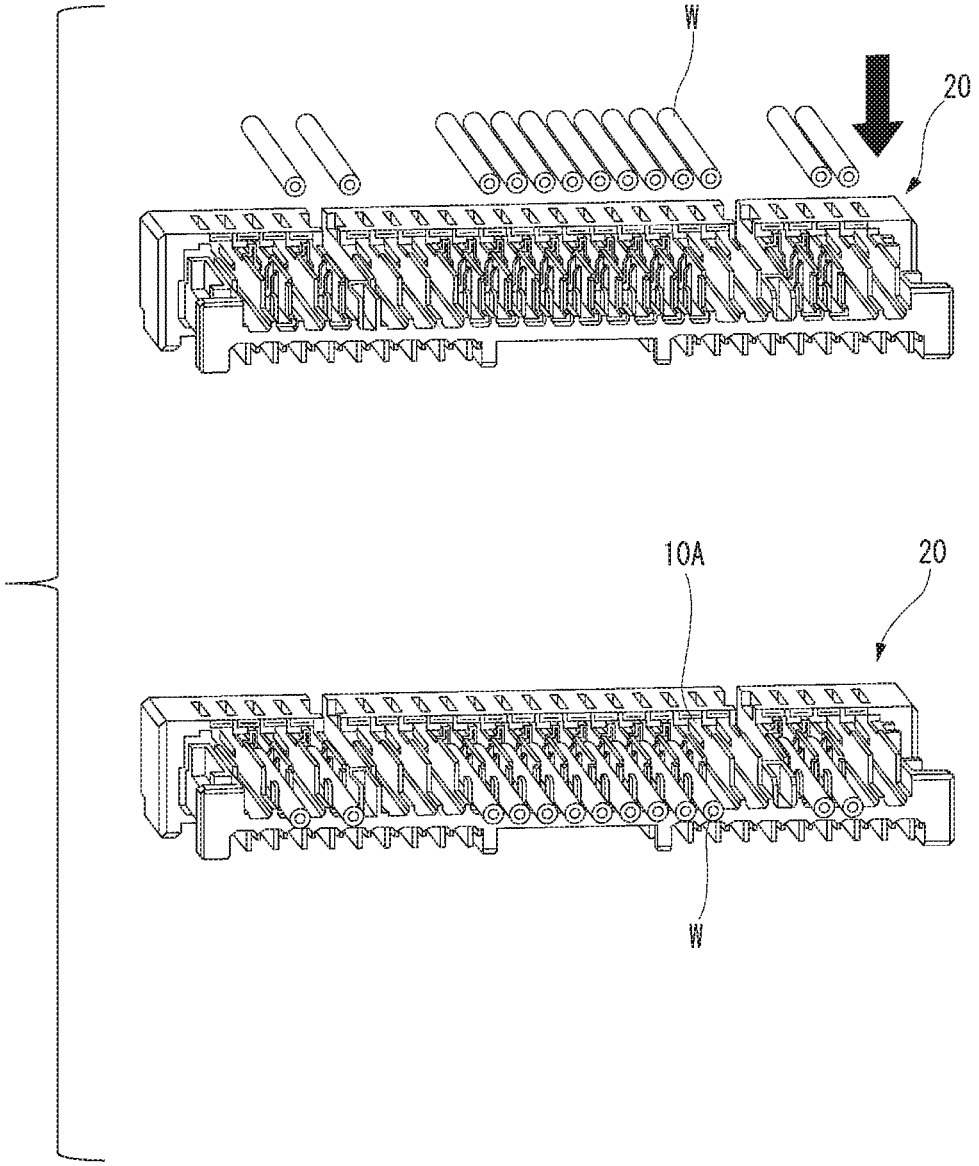
FIG. 24 is a second diagram for explaining the procedure of assembling the connector.

Next, as shown in FIG. 24, electric wires W are respectively connected to the terminals 10A inserted into the terminal accommodating portions by using a predetermined device. Specifically, the conductor core wire of each electric wire W is pressure-welded to the pair of pressure welding blades 19 of the terminal 10A, and the sheath of the electric wire W is pressure-bonded by the pair of crimping pieces 16 of the terminal 10A.

Figure 25:
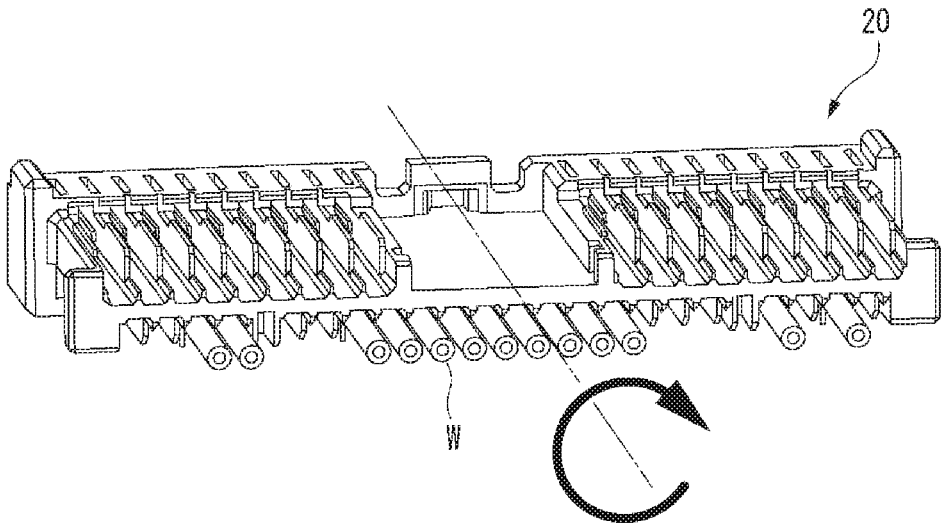
FIG. 25 is a third diagram for explaining the procedure of assembling the connector.
Figure 26:
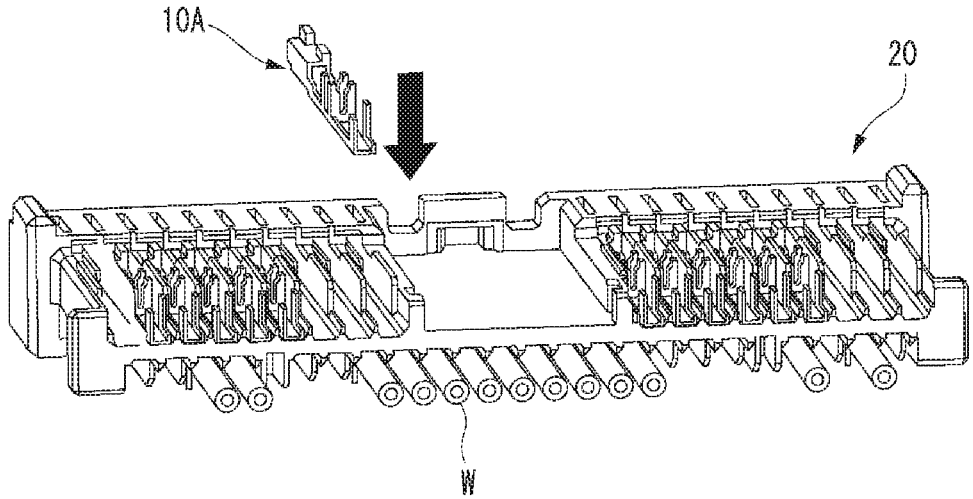
FIG. 26 is a fourth diagram for explaining the procedure of assembling the connector.
Figure 27:
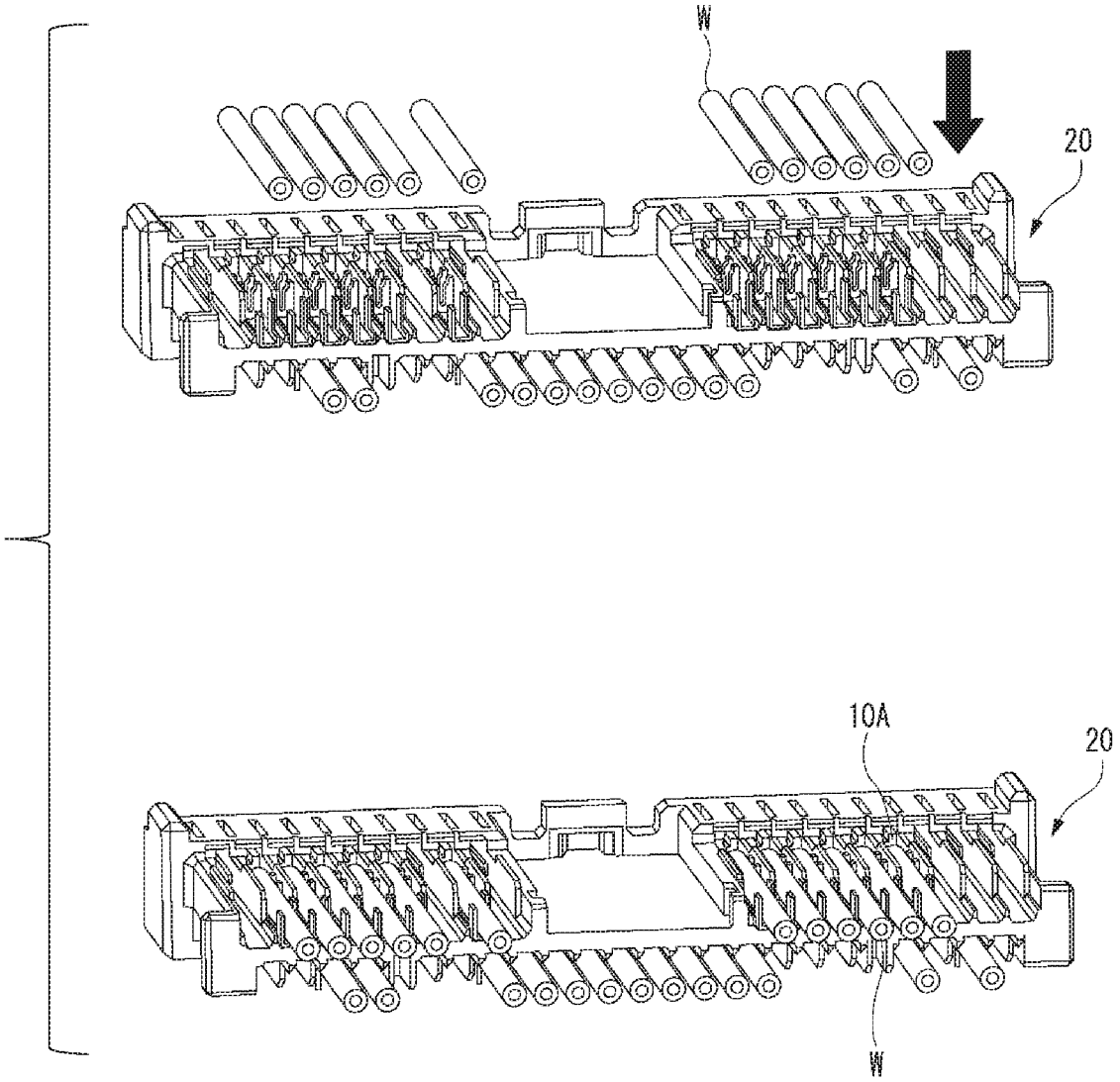
FIG. 27 is a fifth diagram for explaining the procedure of assembling the connector.

Next, as shown in FIG. 25, the housing 20 is reversed. As a result, the orientation of the housing 20 becomes the regular orientation. In this state, similar as the procedure shown in FIG. 23 and FIG. 24, as shown in FIG. 26 and FIG. 27, the terminals 10A are inserted to the predetermined terminal accommodating portions on the upper surface side of the housing 20 to the primary locking positions, and the electric wires W are respectively connected to the inserted terminals 10A.

Figure 28:
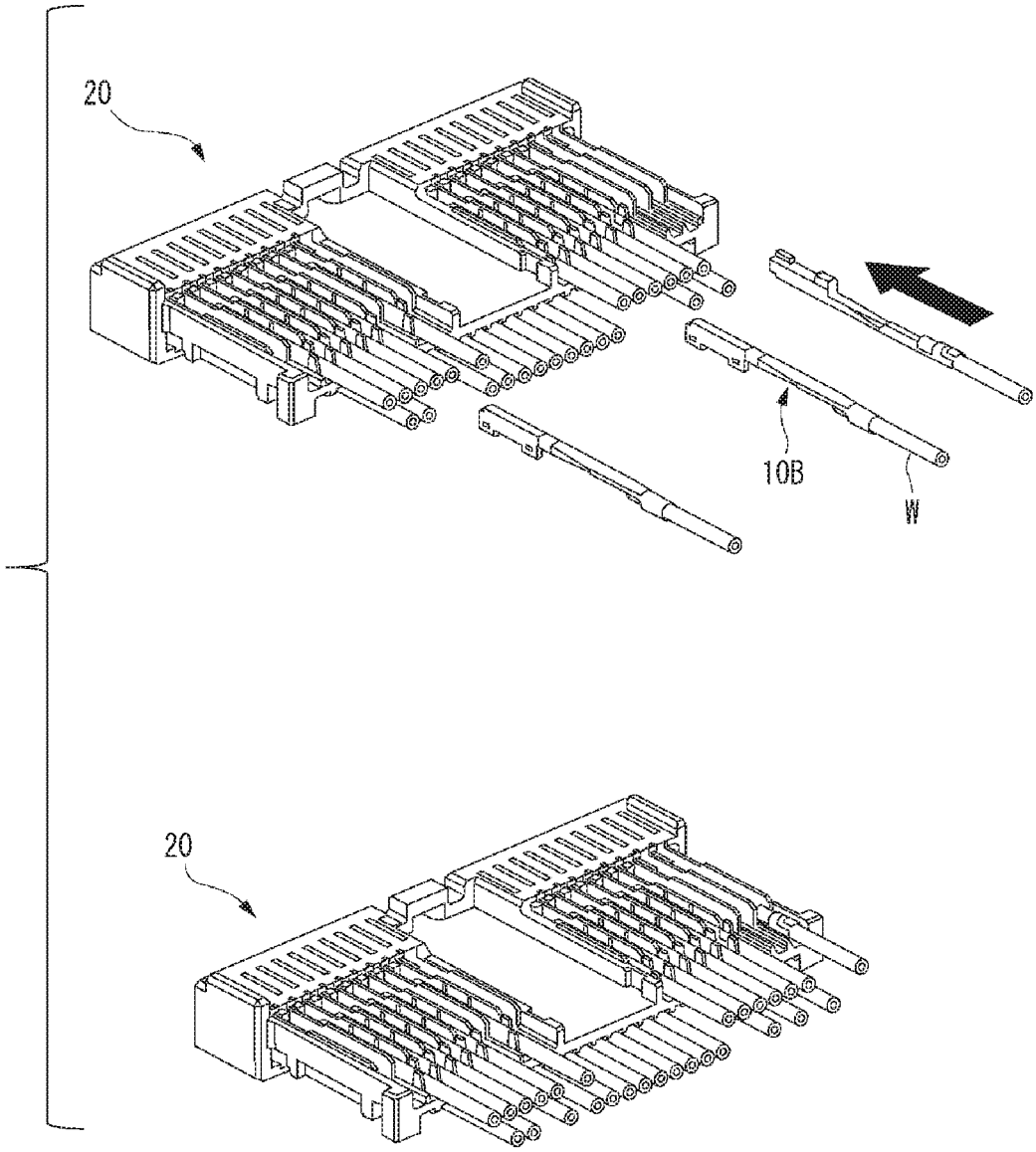
FIG. 28 is a sixth diagram for explaining the procedure of assembling the connector.

Next, as shown in FIG. 28, the terminals 10B, to which the electric wires W are connected in advance, are respectively inserted into predetermined terminal accommodating portions, into which the terminals 10A are not inserted, on the upper surface side or the lower surface side of the housing 20 to the primary locking positions by using a predetermined device. This operation may be performed manually by an operator.

Figure 29:
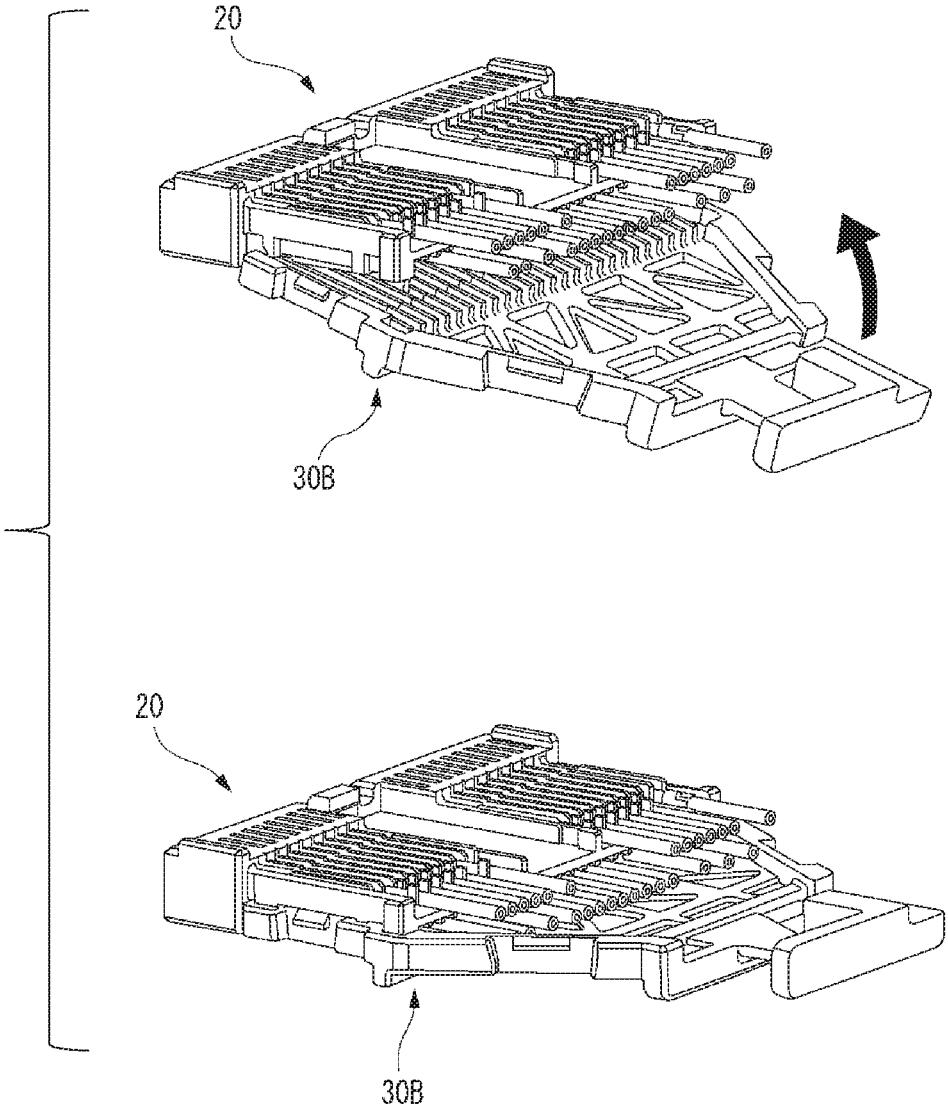
FIG. 29 is a seventh diagram for explaining the procedure of assembling the connector.
Figure 30:
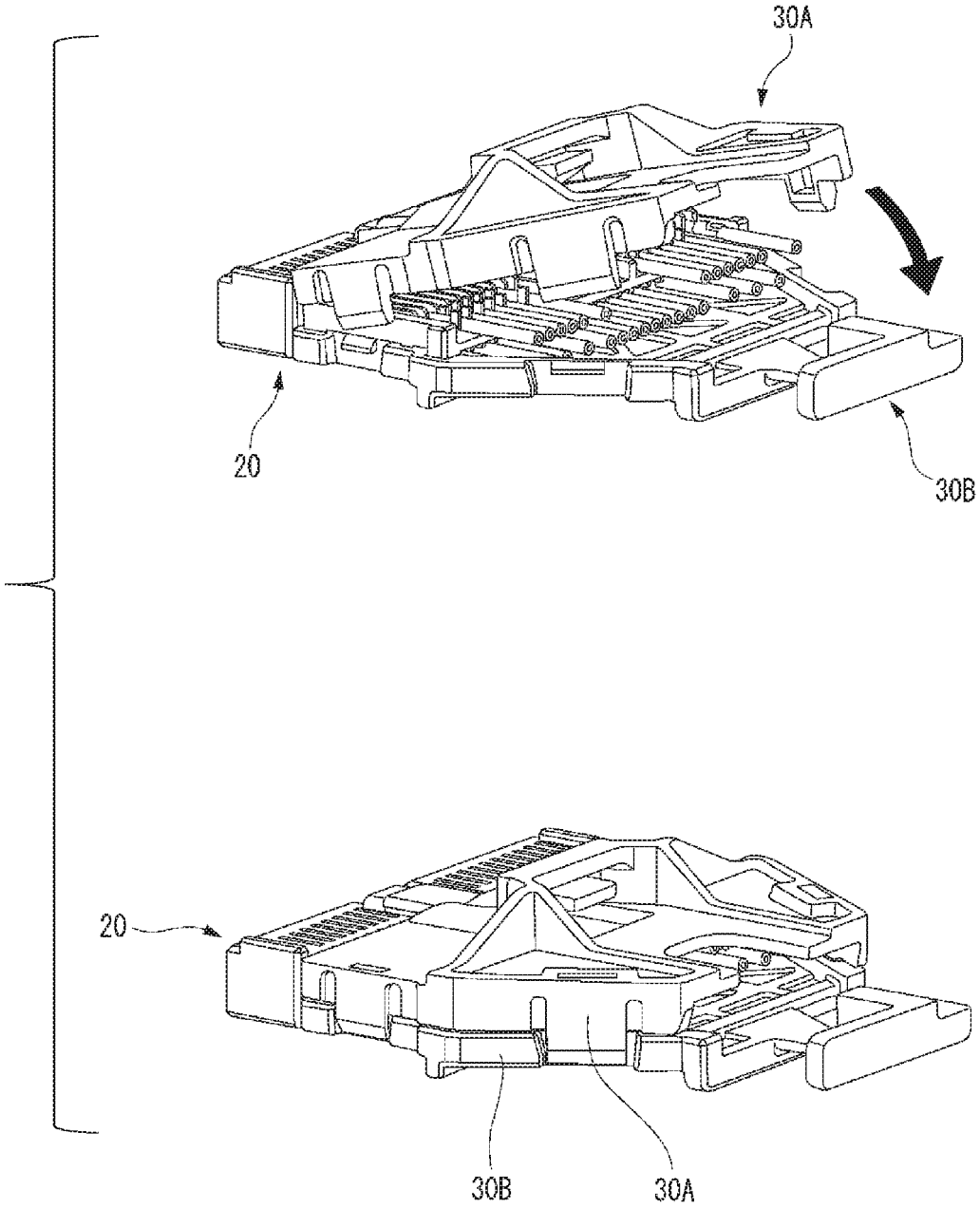
FIG. 30 is an eighth diagram for explaining the procedure of assembling the connector.

Next, as shown in FIG. 29, the lower cover 30B is assembled to the housing 20, and then, as shown in FIG. 30, the upper cover 30A is assembled to the housing 20. The procedures of assembling the upper cover 30A and the lower cover 30B to the housing 20 are substantially the same except that the upper cover 30A and the lower cover 30B are symmetrical in the upper-lower direction. Therefore, only the procedure of assembling the upper cover 30A to the housing 20 will be described with reference to FIGS. 31 to 35.

Figure 31:
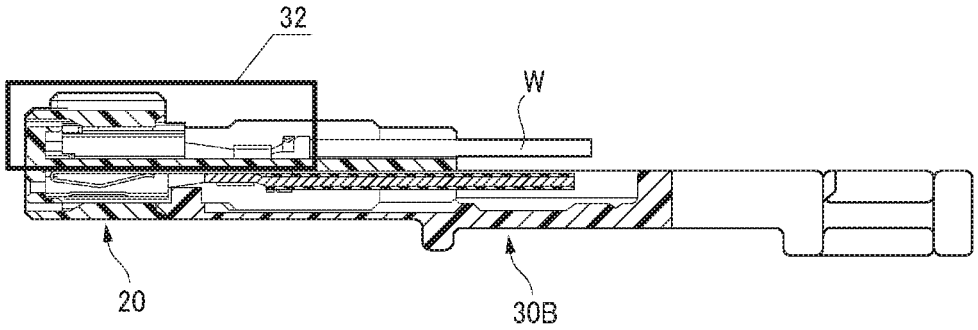
FIG. 31 is a cross-sectional view corresponding to FIG. 8 in the housing in which the terminal is in the primary locking position.
Figure 32:
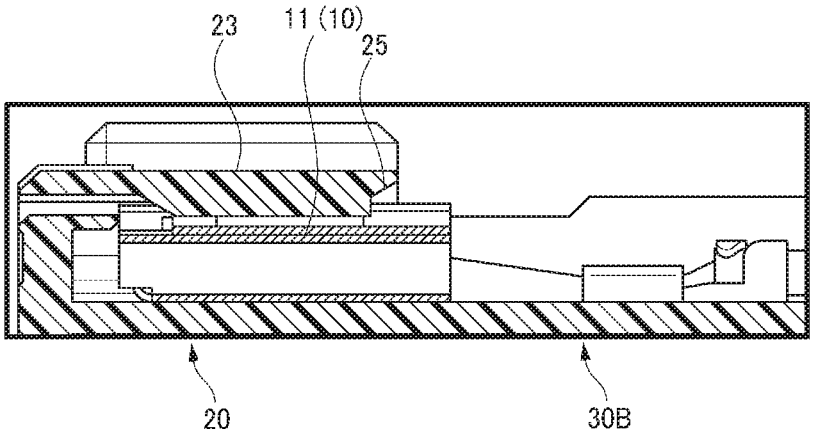
FIG. 32 is an enlarged view of a frame shown by reference numeral 32 in FIG. 31.
Figure 33:
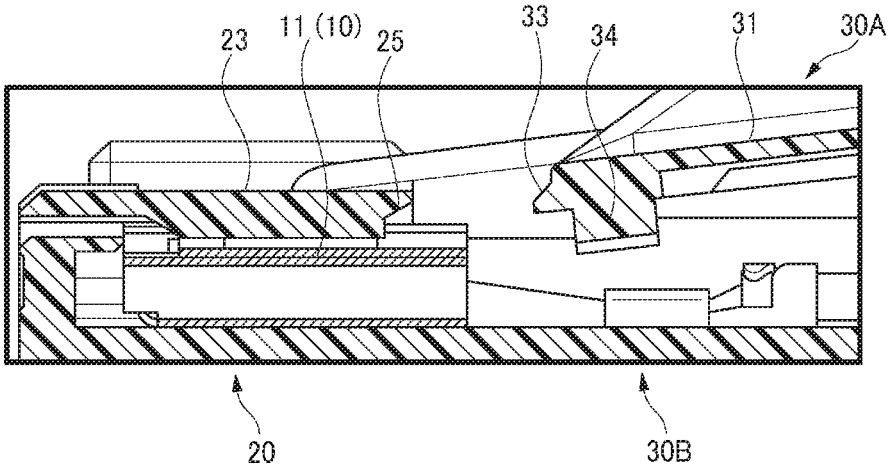
FIG. 33 is a first diagram for explaining assembly steps shown in FIG. 30 in detail.
Figure 34:
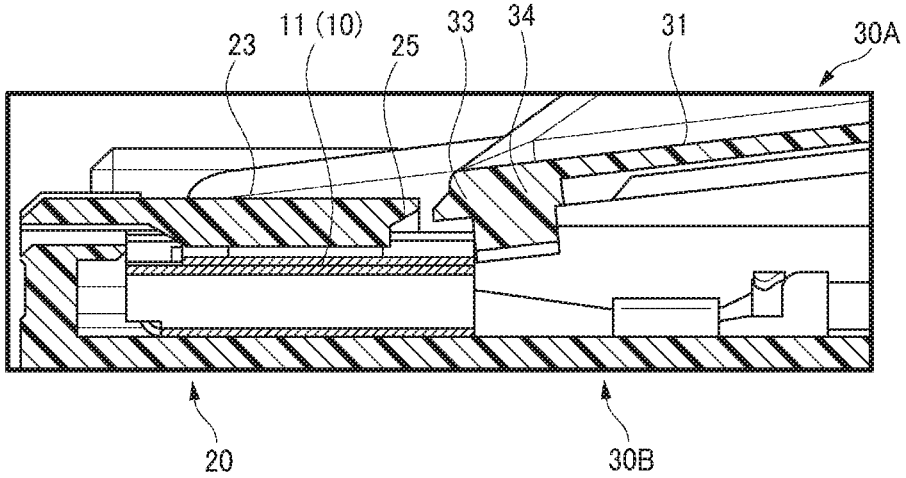
FIG. 34 is a second diagram for explaining the assembly steps shown in FIG. 30 in detail.

In a state in which the terminals 10 inserted into the terminal accommodating portions are in the primary locking position as shown in FIGS. 31 and 32, first, as shown in FIG. 33, the front end edges of the upper cover 30A (the cover main body 31) approach the rear end edges of the top wall portions 23 of the housing 20 while maintaining a state in which the rear side of the upper cover 30A is inclined upward of the front side, and as shown in FIG. 34, the projecting portions 34 of the upper cover 30A come into contact with the rear ends of the connecting portions 11 of the terminals 10.

Next, while maintaining this state (that is, the state in which the upper cover 30A is inclined and the projecting portions 34 are in contact with the connection portions 11 of the terminals 10), the upper cover 30A is moved in parallel to the housing 20 until the tapered surfaces 33 of the front end edge of the upper cover 30A enter below the tapered surface 25 of the rear end edge of the top wall portions 23 (until the front end edges of the upper cover 30A are engaged with the rear end edges of the top wall portions 23). At this time, due to pressing of the projecting portions 34, the terminals 10 move from the primary locking positions to the regular insertion positions along with forward movement of the upper cover 30A.

Figure 35:
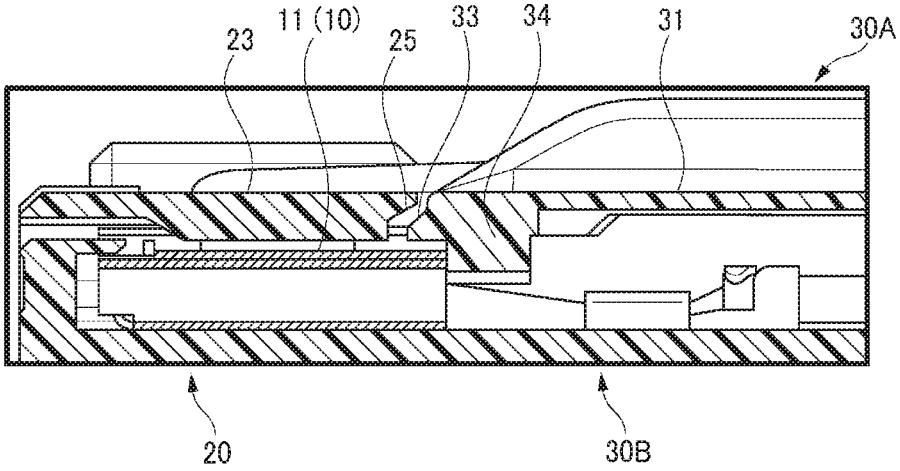
FIG. 35 is a third diagram for explaining the assembly steps shown in FIG. 30 in detail.

Next, while maintaining a state in which the front end edges of the upper cover 30A are engaged with the rear end edges of the top wall portions 23, the upper cover 30A in the inclined state is rotated around a tip end side of the upper cover 30A as shown in FIG. 35 such that the rear side of the upper cover 30A approaches the housing 20. As a result, the plurality of engaging portions 35 of the upper cover 30A and the plurality of engaging portions 36 of the lower cover 30B are engaged with one another so as to obtain a state in which the upper cover 30A and the lower cover 30B are assembled to the housing 20 as shown in FIG. 20. Finally, the plurality of electric wires W extending rearward from the housing 20 are held in the electric wire holding portion 38 in a bundled state using a tie band or the like. Thus, assembly of the connector 1 is completed.

As shown in FIG. 20, in a state in which the upper cover 30A is assembled to the housing 20, the projecting portions 34 of the upper cover 30A are in surface contact with or close to the rear end faces of the connecting portions 11 of the terminals 10. Therefore, the function of preventing the terminal 10 from coming off from the housing 20 is exhibited. That is, in addition to engagement of the projection portions 14 of the terminals 10 and the lances 26, due to engagement between the connection portions 11 of the terminals 10 and the projection portions 34, a so-called double lock state is obtained.

As described above, the upper cover 30A is designed to be attached to the housing 20 in a regular state only by rotating the upper cover 30A in an inclined state around the tip end side of the upper cover 30A. Even when the upper cover 30A is moved in parallel to the housing 20 downward from the upper side while being kept parallel to the housing 20 so as to be assembled to the housing 20, the front end edges of the upper cover 30A and the rear end edges of the top wall portions 23 interfere with one another, so that the upper cover 30A can not be assembled.

Figure 36:
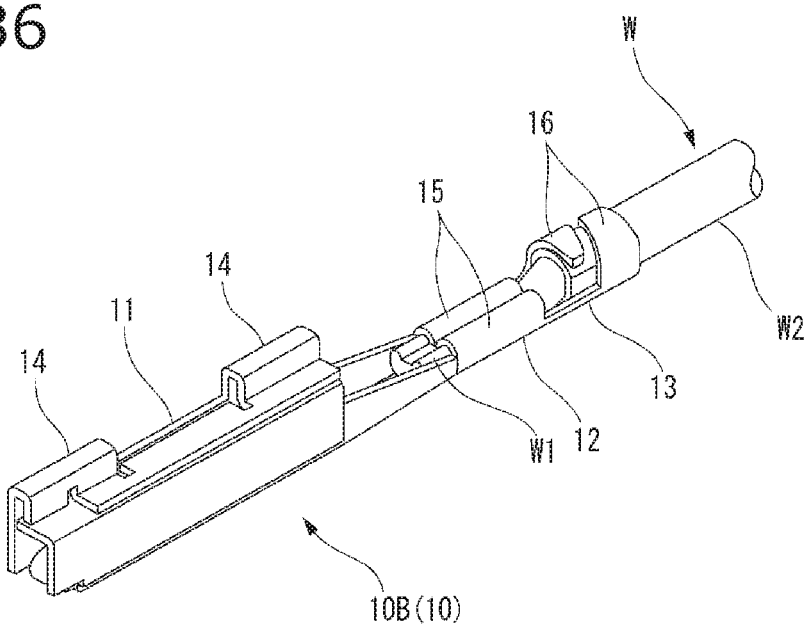
FIG. 36 is a perspective view of the electric wire with terminal in which the electric wire is connected to the second terminal shown in FIGS. 2 and 4.
Figure 37:
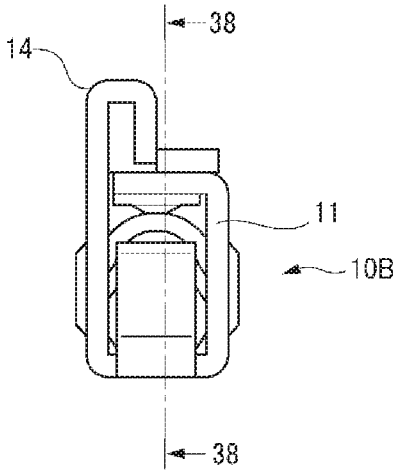
FIG. 37 is a front view of the electric wire with terminal shown in FIG. 36.
Figure 38:
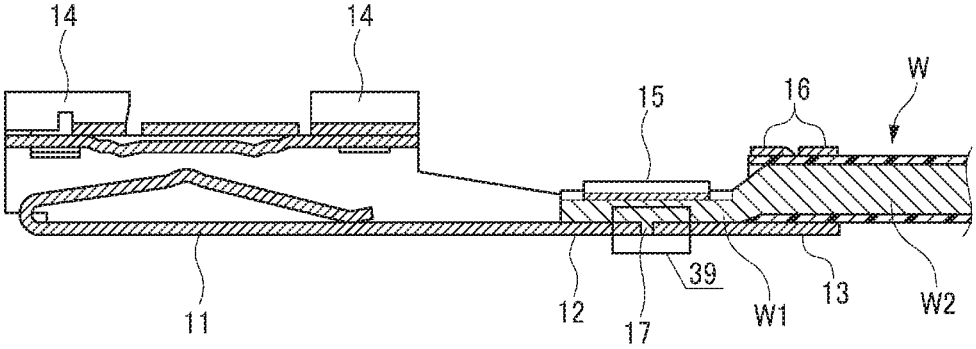
FIG. 38 is a cross-sectional view taken along line 38-38 of FIG. 37.

Hereinafter, the through holes 17 (see FIG. 5) of the conductor fixing portion 12 of the terminal 10B shown in FIGS. 2 and 4 will be described with reference to FIGS. 36 to 48. As shown in FIGS. 36 to 38, the terminal 10B becomes an electric wire with terminal by pressure-contact a conductor core wire W1 exposed from the electric wire W with the pair of crimping pieces 15 of the conductor fixing portion 12 and by pressure-contact a sheath W2 of the electric wire W with the pair of crimping pieces 16 of the sheath fixing portion 13.

Figure 39:
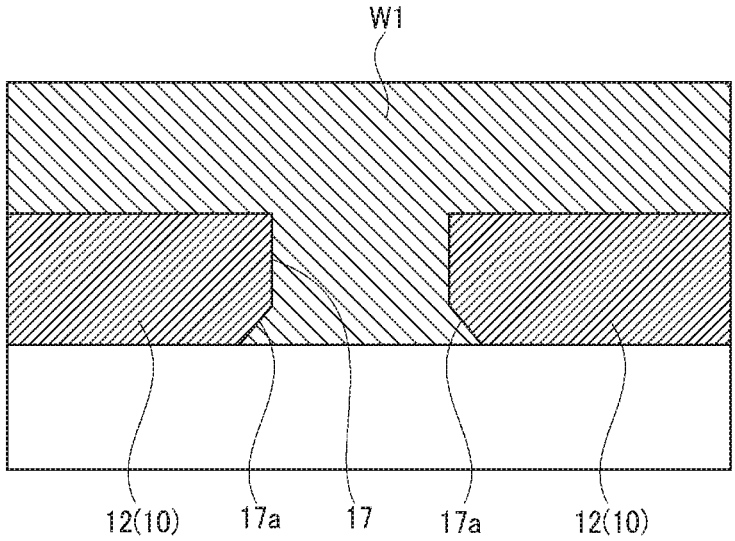
FIG. 39 is an enlarged view of a frame shown by reference numeral 39 in FIG. 38.

As shown in FIG. 39, which is an enlarged view of a part of FIG. 38, each of the plurality of through holes 17 (see FIG. 5) formed in the conductor fixing portion 12 of the terminal 10B is provided with a tapered portion 17*a* that increases in diameter toward the outer peripheral surface of the conductor fixing portion 12 at an end edge portion on the outer peripheral surface side. Therefore, the conductor core wire W1 enters the tapered portion 17*a* of each through hole 17 and is in close contact with the tapered portion 17*a* due to a pressure during pressure contact of the conductor fixing portion 12 (the pair of crimping pieces 15) (see FIG. 39).

Therefore, even if the conductor core wire W1 tends to be separated from the conductor fixing portion 12 due to a small tightening force of the conductor fixing portion 12 caused by a small thickness of a metal plate constituting the conductor fixing portion 12, portions of the conductor core wire W1 that are in close contact with the tapered portions 17*a* (hereinafter referred to as "tapered contact portions") are hooked by the tapered portions 17*a*. As a result, the conductor core wire W1 can be held on the conductor fixing portion 12. That is, it is possible to maintain a state in which the conductor core wire W1 is held by the conductor fixing portion 12 of the terminal 10B even when the thickness of the metal plate constituting the conductor fixing portion 12 is small.

Further, even if the conductor core wire W1 tends to be separated from the conductor fixing portion 12 due to expansion and contraction of the conductor fixing portion 12 caused by temperature variation, since the tapered contact portions of the conductor core wire W1 are respectively hooked by the tapered portions 17*a*, the conductor core wire follows the expansion and contraction of the conductor fixing portion. As a result, a contact area between the conductor core wire W1 and the conductor fixing portion 12 is unlikely to reduce, and a contact resistance can be prevented from rising.

Figure 40:
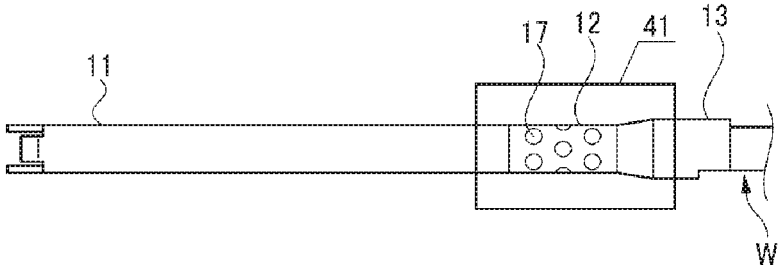
FIG. 40 is a bottom view of the electric wire with terminal shown in FIG. 36.
Figure 41:
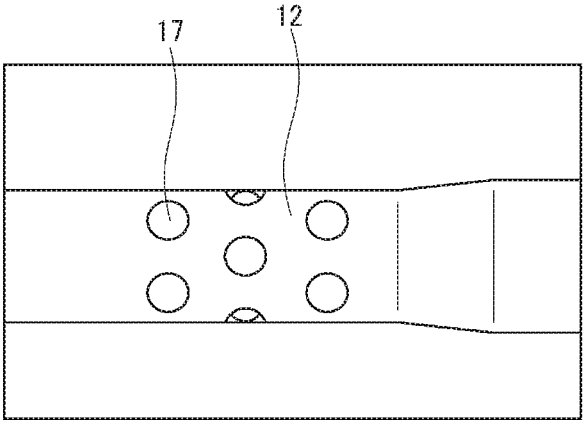
FIG. 41 is an enlarged view of a frame shown by reference numeral 41 in FIG. 40.

Further, as can be understood from FIGS. 40 and 41, appearance inspection for checking entering amounts of the conductor core wire W1 into each of the plurality of through holes 17 formed on the conductor fixing portion 12 can be performed visually from a back surface side of the terminal 10B, which contributes to prevention of outflow of terminals 10B having pressure contact failure.

Figure 42:
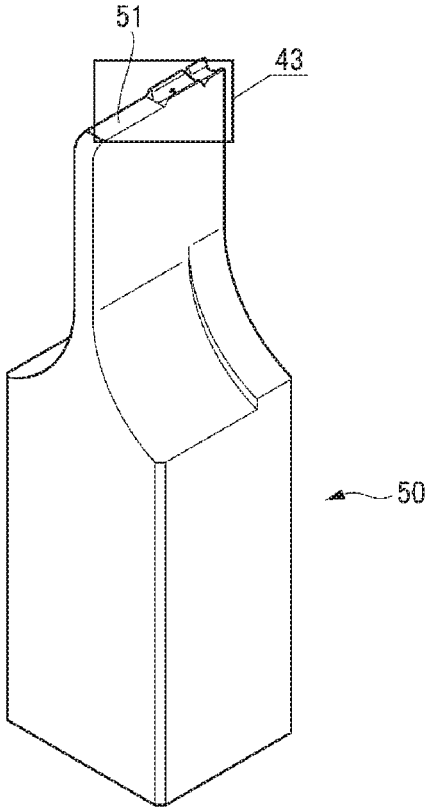
FIG. 42 is a perspective view of an anvil used when crimping a pair of crimping pieces of the conductor fixing portion of the second terminal.
Figure 43:
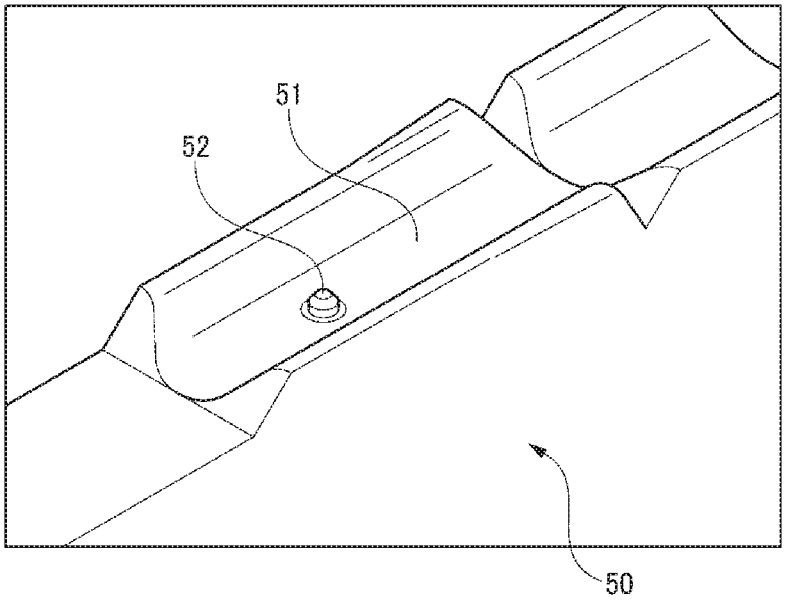
FIG. 43 is an enlarged view of a frame shown by reference numeral 43 in FIG. 42.
Figure 44:
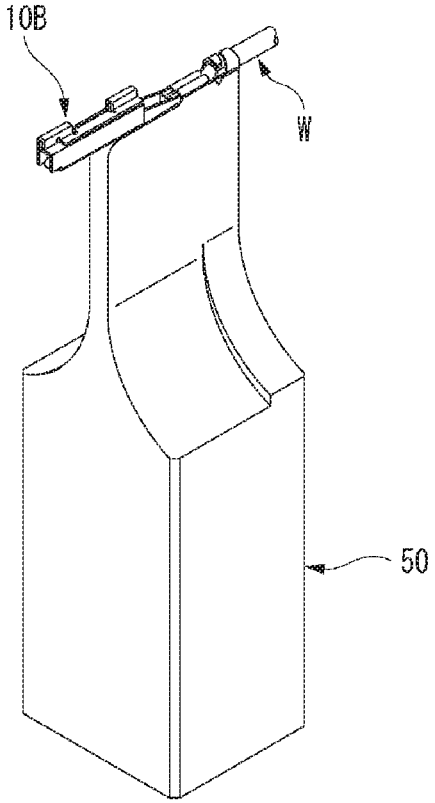
FIG. 44 is a perspective view showing a state in which the second terminal is placed on the anvil.
Figure 45:
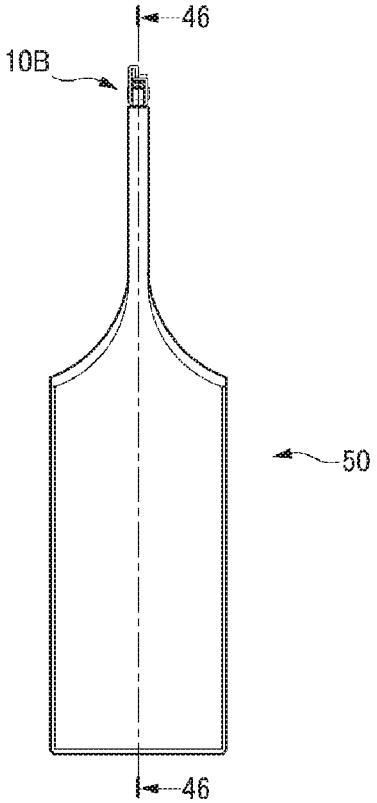
FIG. 45 is a front view showing a state in which the second terminal is placed on the anvil.
Figure 46:
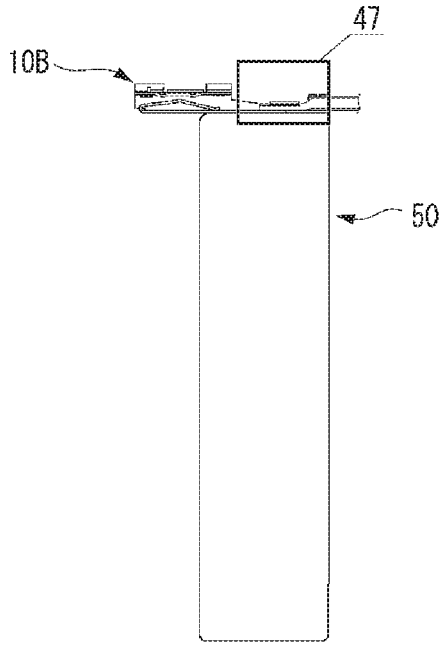
FIG. 46 is a side view showing a state in which the second terminal is placed on the anvil.
Figure 47:
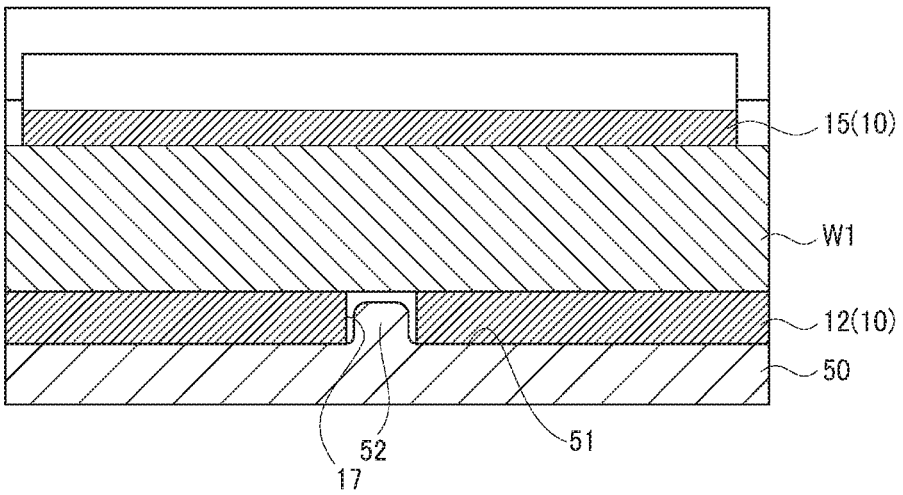
FIG. 47 is an enlarged view of a frame shown by reference numeral 47 in FIG. 46.

Pressure contact of the conductor fixing portion 12 of the terminal 10B is performed by pressing a crimper (not shown) from above toward a mounting surface 51 of an anvil 50 shown in FIGS. 42 and 43 in a state in which the conductor fixing portion 12 of the terminal 10B is mounted on the mounting surface 51 of the anvil 50, as shown in FIGS. 44 to 46.

Figure 48:
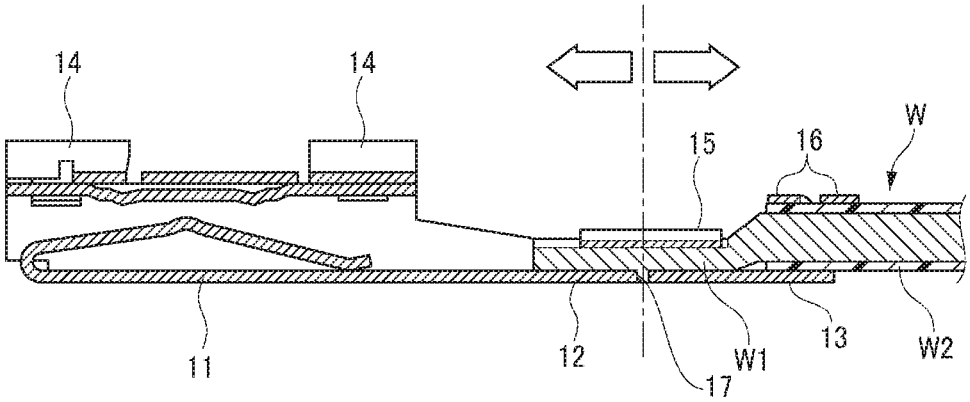
FIG. 48 is a diagram for explaining that the conductor fixing portion is elongated uniformly in the front-rear direction via pressure contact.

Here, as shown in FIG. 43, a projection 52 is formed on the mounting surface 51 of the anvil 50. The projection 52 is pressure-bonded in a positioning state (see FIGS. 46 and 47) in which the projection 52 is inserted into a through hole 17 among the plurality of through holes 17 (see FIG. 5) that is located at a center in the front-rear direction and the width direction of the conductor fixing portion 12 and penetrates in the upper-lower direction. As a result, as shown in FIG. 48, it is easy to elongate the conductor fixing portion 12 uniformly in the front-rear direction and the width direction via pressure contact. As a result, quality related to pressure contact can be managed easily.

Other Embodiments

The present invention is not limited to the above embodiments, and various modifications can be adopted within the scope of the present invention. For example, the present invention is not limited to the above embodiment, and can be appropriately modified, improved or the like. In addition, respective configuration elements of the embodiments are arbitrary and not limited in view of a material, a shape, a dimension, a quantity, an arrangement location, or the like, so long as the present invention can be achieved.

In the above embodiment, the tapered portions 17*a* (see FIG. 39) are formed in all of the plurality of through holes 17 (see FIG. 5) formed in the conductor fixing portion 12 of the terminal 10B. On the other hand, the tapered portions 17*a* may be formed only in some of the through holes 17 among the plurality of through holes 17, and the tapered portions 17*a* may not be formed in the other through holes 17.

Here, characteristics of the embodiments of the terminal 10B and the electric wire with terminal according to the present invention described above are summarized briefly in the following [1] to [3], respectively.

[1] A terminal (10B) that is configured to be connected to a tip end of an electric wire (W) including a conductor core wire (W1) and a sheath (W2) covering the conductor core wire (W1), the terminal (10B) including:

a connection portion (11) configured to be connected to a mating terminal; and a conductor fixing portion (12) located rearward of the connecting portion (11) and configured to fix the conductor core wire (W1) exposed from the electric wire (W), in which the connection portion (11) and the conductor fixing portion (12) are integrally formed to each other and are extended in a front-rear direction;

in which the conductor fixing portion (12) has a plurality of through holes (17) penetrating in a thickness direction which is substantially perpendicular to both of the front-rear direction and a width direction of the conductor fixing portion (12), and in which an end edge portion of each of the plurality of through holes (17) on an outer peripheral surface side of the conductor fixing portion (12) is provided with a tapered portion (17*a*) that increases in diameter of the tapered portion toward an outer peripheral surface of the conductor fixing portion.

[2] The terminal (10B) according to [1] above, in which one of the plurality of through holes (17) is located at a center in the front-rear direction and at a center in the width direction of the conductor fixing portion (12).

[3] The terminal (10B) according to [1] above, in which the electric wire (W) is mounted on an inner peripheral surface of the conductor fixing portion (12) which is opposite to the outer peripheral surface.

[4] An electric wire with a terminal including:

the terminal (10B) according to any one of [1] to [3] above; and the electric wire (W) whose conductor core wire (W1) is fixed by the conductor fixing portion (12) via pressure contact, in which the conductor core wire (W1) enters into the tapered portions (17*a*) of the through holes (17) and is in close contact with the tapered portions (17*a*).

What is claimed is:

1. A terminal that is configured to be connected to a tip end of an electric wire including a conductor core wire and a sheath covering the conductor core wire, the terminal comprising:

a connection portion configured to be connected to a mating terminal; and a conductor fixing portion located rearward of the connecting portion and configured to fix the conductor core wire exposed from the electric wire, wherein the connection portion and the conductor fixing portion are integrally formed to each other and are extended in a front-rear direction;

wherein the conductor fixing portion has a plurality of through holes penetrating in a thickness direction which is substantially perpendicular to both of the front-rear direction and a width direction of the conductor fixing portion; and wherein an end edge portion of each of the plurality of through holes on an outer peripheral surface side of the conductor fixing portion is provided with a tapered portion that increases in diameter of the tapered portion toward an outer peripheral surface of the conductor fixing portion.

2. The terminal according to claim 1, wherein one of the plurality of through holes is located at a center in the front-rear direction and at a center in the width direction of the conductor fixing portion.

3. The terminal according to claim 1, wherein the electric wire is mounted on an inner peripheral surface of the conductor fixing portion which is opposite to the outer peripheral surface.

4. An electric wire with a terminal, comprising:

the terminal according to claim 1; and the electric wire whose conductor core wire is fixed by the conductor fixing portion via pressure contact, wherein the conductor core wire enters into the tapered portions of the through holes and is in close contact with the tapered portions.

* * * * *